US011203208B2

(12) United States Patent
Kimura et al.

(10) Patent No.: US 11,203,208 B2
(45) Date of Patent: Dec. 21, 2021

(54) PRINTING APPARATUS AND CAN BODY MANUFACTURING SYSTEM

(71) Applicant: SHOWA ALUMINUM CAN CORPORATION, Tokyo (JP)

(72) Inventors: Nobuhiko Kimura, Tokyo (JP); Shinichi Ojima, Tokyo (JP); Kazunori Ikeda, Tokyo (JP); Asumi Suwa, Tokyo (JP); Kazuhisa Masuda, Tokyo (JP)

(73) Assignee: SHOWA ALUMINUM CAN CORPORATION, Tokyo (JP)

( * ) Notice: Subject to any disclaimer, the term of this patent is extended or adjusted under 35 U.S.C. 154(b) by 322 days.

(21) Appl. No.: 16/311,165

(22) PCT Filed: Jun. 5, 2017

(86) PCT No.: PCT/JP2017/020811
§ 371 (c)(1),
(2) Date: Dec. 19, 2018

(87) PCT Pub. No.: WO2018/008315
PCT Pub. Date: Jan. 11, 2018

(65) Prior Publication Data

US 2020/0009879 A1 Jan. 9, 2020

(30) Foreign Application Priority Data

Jul. 8, 2016 (JP) ..... JP2016-136103
Jan. 30, 2017 (JP) ..... JP2017-014603

(51) Int. Cl.
*B41J 3/407* (2006.01)
*B41J 2/01* (2006.01)
*B41M 5/00* (2006.01)

(52) U.S. Cl.
CPC ..... *B41J 3/4073* (2013.01); *B41J 2/01* (2013.01); *B41J 3/40733* (2020.08); *B41M 5/0088* (2013.01)

(58) Field of Classification Search
CPC ... B41N 3/08; G03F 7/039; G03F 7/11; G03F 7/3057; G03F 7/3071; G03F 7/3092;
(Continued)

(56) References Cited

U.S. PATENT DOCUMENTS 6,135,654 A * 10/2000 Jennel ..... B41J 2/01 400/61
6,578,474 B1 6/2003 Sasaki
(Continued)

FOREIGN PATENT DOCUMENTS

CN 203497578 3/2014
CN 104129172 11/2014
(Continued)

OTHER PUBLICATIONS

"Search Report of Europe Counterpart Application", dated Mar. 12, 2020, p. 1-p. 9.
(Continued)

*Primary Examiner* — David H Banh
(74) *Attorney, Agent, or Firm* — JCIP Global Inc.

(57) ABSTRACT

A printing apparatus (500) is provided with a moving unit (550) used to convey a can body (10). In addition, the printing apparatus (500) is provided with a first linear unit (610) in a linear shape which the moving unit (550) travels to move in one direction. Moreover, the printing apparatus (500) is provided with a second linear unit (620) which the moving unit (550) travels to move in a direction opposite to the one direction, the second linear unit (620) being arranged in parallel with the first linear unit (610) and formed linearly. Further, the printing apparatus (500) is provided with a
(Continued)

printing unit (520) that performs printing on the can body (10) held by the moving unit (550). By these units, the miniaturization of a printing apparatus and a can body manufacturing system is attained.

6 Claims, 16 Drawing Sheets

(58) Field of Classification Search
CPC ... G03F 7/32; G03F 7/322; G03F 7/40; B41F 17/14; B41F 17/08; B41F 17/20; B41F 17/22; B41F 7/006; B41F 7/007
See application file for complete search history.

(56) References Cited

U.S. PATENT DOCUMENTS

| | | | | |
|---|---|---|---|---|
| 10,442,212 | B2 * | 10/2019 | Belval | B41J 3/4073 |
| 2005/0115422 | A1 * | 6/2005 | Louviere | B41F 17/22 101/44 |
| 2010/0039487 | A1 | 2/2010 | Sawatsky | |
| 2010/0192517 | A1 | 8/2010 | Schach | |
| 2010/0257819 | A1 | 10/2010 | Schach | |
| 2011/0067584 | A1 | 3/2011 | Mueller et al. | |
| 2012/0216689 | A1 * | 8/2012 | Cochran | B41F 33/02 101/39 |
| 2013/0019566 | A1 * | 1/2013 | Schach | B41J 3/543 53/411 |
| 2013/0063505 | A1 | 5/2013 | Buchkremer | |
| 2014/0028771 | A1 | 1/2014 | Yamada et al. | |
| 2015/0138295 | A1 | 5/2015 | Lindner et al. | |
| 2015/0174917 | A1 * | 6/2015 | Noll | B41F 19/007 101/485 |
| 2016/0136966 | A1 | 5/2016 | Cassoni et al. | |
| 2016/0136967 | A1 * | 5/2016 | Allen | B41J 3/4073 428/35.7 |
| 2016/0136968 | A1 | 5/2016 | Cassoni et al. | |
| 2016/0136969 | A1 | 5/2016 | Allen et al. | |
| 2016/0221328 | A1 | 8/2016 | Till | |
| 2016/0229198 | A1 * | 8/2016 | Izume | B41F 31/12 |
| 2016/0355025 | A1 | 12/2016 | Ojima et al. | |
| 2017/0050446 | A1 | 2/2017 | Clippingdale et al. | |
| 2017/0157964 | A1 * | 6/2017 | Izume | B41J 3/44 |
| 2020/0009879 | A1 | 1/2020 | Kimura et al. | |

FOREIGN PATENT DOCUMENTS

| | | |
|---|---|---|
| DE | 4435199 | 4/1996 |
| DE | 102010020958 | 11/2011 |
| EP | 2100733 | 9/2009 |
| EP | 2942195 | 11/2015 |
| JP | 2000218214 | 8/2000 |
| JP | 2003084698 | 3/2003 |
| JP | 2007144729 | 6/2007 |
| JP | 2008183613 A | 8/2008 |
| JP | 2011230797 | 11/2011 |
| JP | 2012232771 | 11/2012 |
| JP | 2013051237 | 3/2013 |
| JP | 2016013548 A | 7/2015 |
| JP | 2015147159 | 8/2015 |
| JP | 2015526312 A | 9/2015 |
| JP | 2015196325 A | 11/2015 |
| JP | 2015227002 A | 12/2015 |
| JP | 2018012320 | 1/2018 |
| WO | 2009018892 | 2/2009 |
| WO | 2013178418 | 12/2013 |
| WO | 2015036555 | 3/2015 |
| WO | 2015166228 | 11/2015 |
| WO | 2016077199 | 5/2016 |
| WO | 2016077201 | 5/2016 |
| WO | 2016077204 | 5/2016 |

OTHER PUBLICATIONS

"International Search Report (Form PCT/ISA/210) of PCT/JP2047/020811", dated Jul. 11, 2017, with English translation thereof, pp. 1-4.
JPOA dated Jul. 27, 2021 and English Translation thereof.

* cited by examiner

PRINTING APPARATUS AND CAN BODY MANUFACTURING SYSTEM

CROSS-REFERENCE TO RELATED APPLICATION

This application is a 371 application of the International PCT application serial no. PCT/JP2017/020811, filed on Jun. 5, 2017, which claims the priority benefits of Japan Patent Application No. 2016-136103, filed on Jul. 8, 2016 and Japan Patent Application No. 2017-014603, filed on Jan. 30, 2017. The entirety of each of the above-mentioned patent applications is hereby incorporated by reference herein and made a part of this specification.

TECHNICAL FIELD

The present invention relates to a printing apparatus and a can body manufacturing system.

BACKGROUND ART

In Patent Document 1, there is disclosed a printing device, in which inkjet printing is performed in at least one inkjet printing station, and plural inkjet heads are arranged in the inkjet printing station.

CITATION LIST

Patent Literature

Patent Document 1: Japanese Patent Application Laid-Open Publication No. 2012-232771

SUMMARY OF INVENTION

Technical Problem

In a printing apparatus, in some cases, a can body is conveyed to a printing unit or the like by moving a moving body that moves while holding the can body.

Here, if a route on which the moving body moves is bent, dead space is likely to be generated and upsizing of the printing apparatus is caused. Moreover, when a route on which the moving body moves is provided on a single horizontal surface, an occupation area of the printing apparatus is likely to be increased.

Moreover, when plural printing apparatuses are provided to a can body manufacturing system, if facilities required for manufacturing the can bodies are to be commoditized, it is possible to downsize the manufacturing system.

An object of the present invention is to downsize the printing apparatus and the can body manufacturing system.

Solution to Problem

A printing apparatus to which the present invention is applied includes: a moving body used for conveying a can body; a first moving route in a linear shape which the moving body travels when the moving body moves in one direction; a second moving route disposed in parallel with the first moving route and formed in a linear shape, which the moving body travels when the moving body moves in a direction opposite to the one direction; and a printing unit that performs printing on a can body held by the moving body.

Here, the printing unit is provided to the first moving route or the second moving route, and, in a moving route of the first moving route and the second moving route, which is provided with the printing unit, a linear mechanism is used to move the moving body.

Moreover, one moving route of the first moving route and the second moving route is disposed above an other moving route.

Moreover, the printing apparatus further includes a third moving route that moves the moving body from one moving route of the first moving route and the second moving route to an other moving route, and the third moving route is formed into a linear shape and is disposed in a relationship substantially orthogonal to the first moving route and the second moving route.

Moreover, the printing apparatus further includes a moving mechanism that moves the moving body from one moving route of the first moving route and the second moving route to an other moving route, and the moving mechanism includes a rotation body that holds the moving body, the moving mechanism rotating the rotation body to move the moving body from the one moving route to the other moving route.

From another standpoint, a printing apparatus to which the present invention is applied includes: a moving body used for conveying a can body; a first moving route on which the moving body moves; a second moving route which is disposed above the first moving route, on which the moving body moves; and a printing unit that performs printing on a can body held by the moving body.

Here, the printing apparatus further includes a heating unit that heats a can body on which printing by the printing unit is performed, and the printing unit is provided to the first moving route, and the heating unit is provided to the second moving route positioned above the first moving route.

Moreover, the second moving route is provided to a location deviated from directly above the first moving route.

Moreover, the second moving route is provided in parallel with the first moving route.

Moreover, at least one moving route of the first moving route and the second moving route is branched to plural moving routes at a branch part, the plural moving routes joining on a downstream side of the branch part.

Moreover, when the present invention is grasped as a can body manufacturing system, the can body manufacturing system to which the present invention is applied includes: a moving route on which a can body moves, which is branched to plural branch routes at a branch part, the plural branch routes joining on a downstream side of the branch part; an inkjet printing apparatus provided to one branch route included in the plural branch routes, the inkjet printing apparatus performing printing onto a can body by an inkjet method; and a plate printing apparatus provided to an other branch route included in the plural branch routes, the plate printing apparatus performing printing onto a can body by a plate printing method.

Advantageous Effects of Invention

According to the present invention, it is possible to downsize the printing apparatus and the can body manufacturing system.

BRIEF DESCRIPTION OF DRAWINGS

FIG. 12 is a diagram in which the printing apparatus is viewed from one end side in an axial direction of the first linear unit or the like;

DESCRIPTION OF EMBODIMENTS

Hereinafter, an exemplary embodiment according to the present invention will be described in detail with reference to attached drawings.

Figure 1:
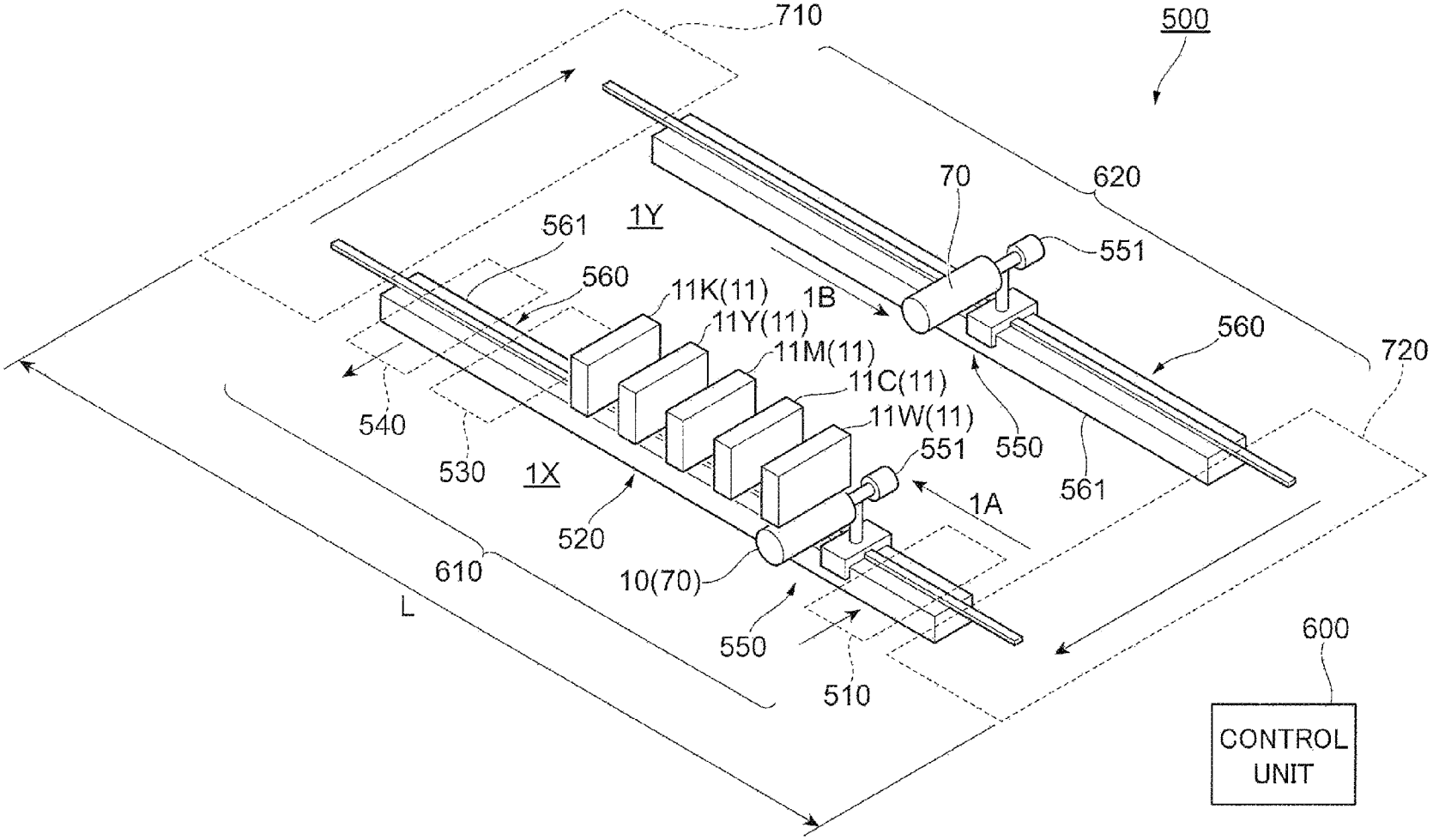
FIG. 1 is a perspective view in which a printing apparatus is viewed from above.

FIG. 1 is a perspective view in which a printing apparatus 500 is viewed from above.

The printing apparatus 500 is provided with plural moving units 550 that move while supporting can bodies 10. Further, the printing apparatus 500 is provided with a first linear unit 610 that moves the moving unit 550 linearly and in one direction (the direction indicated by an arrow 1A in the figure). Moreover, the printing apparatus 500 is provided with a second linear unit 620 that moves the moving unit 550 linearly and in an opposite direction of the above-described one direction (the direction indicated by an arrow 1B in the figure).

Here, the first linear unit 610 can be grasped as a first moving route which the moving unit 550 travels when moving toward an upper left direction in the figure. Moreover, the second linear unit 620 can be grasped as a second moving route which the moving unit 550 travels when moving toward a lower right direction in the figure.

The first moving route and the second moving route are formed into a linear shape. Moreover, the second moving route is provided in parallel with the first moving route. Moreover, in the first moving route, the moving unit 550 moves in one direction, and in the second moving route, the moving unit 550 moves in an opposite direction of the one direction.

Further, the printing apparatus 500 is provided with a first moving mechanism 710 that moves the moving unit 550 having moved through the first linear unit 610 to the second linear unit 620, and a second moving mechanism 720 that moves the moving unit 550 having moved through the second linear unit 620 to the first linear unit 610.

The first moving mechanism 710 and the second moving mechanism 720 are placed at end portions of the first linear unit 610 and the second linear unit 620 in the longitudinal direction thereof. The first moving mechanism 710 and the second moving mechanism 720 hold the moving units 550 to move the moving units 550.

Note that the first linear unit 610, the second linear unit 620, the first moving mechanism 710 and the second moving mechanism 720 are disposed on the same horizontal surface, and the moving units 550 move along the horizontal direction. Moreover, the second linear unit 620 is disposed at a facing position of the first linear unit 610. The first linear unit 610 and the second linear unit 620 are disposed so that the first linear unit 610 and the second linear unit 620 are in parallel with each other.

The first linear unit 610 is provided with: a can body loading unit 510 into which a can body 10 is loaded; a printing unit 520 that performs printing onto the can body 10 that has been loaded; a drying unit 530 that dries the can body 10 on which printing has been finished; and a can body discharge unit 540 that discharges the can body 10 that has been dried.

Further, the first linear unit 610 is provided with a moving mechanism 560 that functions as a moving mechanism that moves the moving units 550. The moving mechanism 560 is formed into a linear shape.

Note that, in the exemplary embodiment, the second linear unit 620 is also provided with the moving mechanism 560.

The printing unit 520 is provided with plural inkjet heads 11 disposed along a direction perpendicular to (crossing) the moving direction of the moving unit 550. Printing using the inkjet heads 11 employs a method without using a plate; therefore, it is possible to avoid the trouble of generating the plate. Moreover, in the printing using the inkjet heads 11, change or modification of printing contents can be carried out with ease and rapidly.

Each of the inkjet heads 11 can be grasped as an image formation unit that performs image formation onto the can body 10, and, in the exemplary embodiment, the printing unit 520 is provided with the plural image formation units.

Specifically, the printing unit 520 is provided with: a first inkjet head 11W that ejects white ink; a second inkjet head 11C that ejects cyan ink; a third inkjet head 11M that ejects magenta ink; a fourth inkjet head 11Y that ejects yellow ink; and a fifth inkjet head 11K that ejects black ink.

In the following description, when there are no particular distinctions among the first inkjet head 11W to the fifth inkjet head 11K, the inkjet heads are simply referred to as "inkjet heads 11".

The five inkjet heads 11, namely, the first inkjet head 11W to the fifth inkjet head 11K perform image formation onto the can body 10 by use of ultraviolet cure ink.

Further, in the exemplary embodiment, in a process in which the can body 10 passes through below the five inkjet heads 11, ink is ejected to the can body 10 from above, and thereby images are formed on the can body 10.

To put it another way, in the exemplary embodiment, the moving unit 550 moves via each of the plural inkjet heads 11 having been provided. In the process of moving, ejection of ink from each of the inkjet heads 11 to the can body 10 is performed, and thereby the images are formed on the can body 10.

Note that, in the exemplary embodiment, the case in which the five inkjet heads 11 are provided is shown as a specific example; however, for example, on a downstream side of the fifth inkjet head 11K, an inkjet head 11 that ejects ink of a special color, such as a corporate color, may be provided further.

The moving unit 550, as an example of a moving body, moves at a predetermined moving speed, and the can body 10 on the moving unit 550 rotates in the circumferential direction at a predetermined rotation speed.

Note that, in FIG. 1, two moving units 550 are shown; however, the printing apparatus 500 is provided with more than two moving units 550.

In the exemplary embodiment, the timing when the can body 10 reaches each of the inkjet heads 11 is determined in advance, and each of the inkjet heads 11 starts ejection of ink to the timing when the can body 10 reaches the inkjet head 11.

Note that it may be possible to form a positioning mark on a surface of the can body 10 by use of the first inkjet head 11W, and on the second and subsequent inkjet heads 11, the ejection timing of ink may be determined by use of the positioning mark.

Moreover, determination of the ejection timing by use of the positioning mark may be performed by reading bar code or a recycling mark, in addition to reading a dedicated mark.

In the drying unit 530, for example, a UVLED (ultraviolet LED) (not shown in the figure) is installed. Moreover, the drying unit 530 is disposed on a downstream side of the printing unit 520. The drying unit 530 irradiates the can body 10 with ultraviolet light, to thereby cure an image formed on an outer circumferential surface of the can body 10.

In the exemplary embodiment, as described above, image formation onto the can body 10 is performed by use of the ultraviolet cure ink. The drying unit 530 irradiates the can body 10 with ultraviolet light, to thereby cure the image on the can body 10.

Note that, when image formation onto the can body 10 is performed, thermosetting ink may also be used; in this case, in the drying unit 530, heat is applied to the can body 10 to cure the image on the can body 10.

The moving mechanism 560 provided to each of the first linear unit 610 and the second linear unit 620 is provided with a guide member 561 that guides the moving unit 550.

Inside the guide member 561, an electromagnet (not shown in FIG. 1) is provided. Moreover, in the moving unit 550, a permanent magnet (not shown in FIG. 1) is provided. In the exemplary embodiment, the moving units 550 are moved by use of a linear mechanism.

Specifically, a propulsive force occurs in the moving unit 550 by magnetic fields generated by the electromagnet provided to the guide member 561 and the permanent magnet provided to the moving unit 550, and thereby the moving unit 550 moves.

In conveyance by use of the linear mechanism, the moving speed of the moving unit 550 can be changed with ease. Moreover, the moving unit 550 can be moved backward. Further, it is possible to control the moving speed of each moving unit 550.

Further, in conveyance using the linear mechanism, it is possible to perform high-speed conveyance and have extensibility of the conveyor line. To additionally describe, it is possible to set the conveyor line to an arbitrary length. Moreover, in the conveyance using the linear mechanism, there is provided a simple structure and space savings are available.

Further, the printing apparatus 500 is provided with a control unit 600 that controls energization of the electromagnet to move the moving unit 550. The control unit 600 is composed of a program-controlled CPU (Central Processing Unit).

Moreover, in the exemplary embodiment, on the moving route of the moving unit 550, a detection sensor (not shown in the figure) that detects the position of the moving unit 550 is provided. Based on the detection results of the detection sensor, the control unit 600 performs position control, speed control, and so on, of the moving unit 550.

In the exemplary embodiment, the moving unit 550 is stopped beneath each of the plural inkjet heads 11 that are provided, to thereby perform image formation onto the can body 10; however, in each of the inkjet heads 11, if positioning accuracy of the moving unit 550 with respect to the inkjet head 11 is poor (if accuracy of the stop position is poor), images of respective colors formed on the can body 10 are deviated from one another, to thereby deteriorate the quality of the image to be formed.

When the linear mechanism is used as in the exemplary embodiment, for example, it is possible to set the accuracy of the stop position within 100 μm, and therefore, it is possible to reduce deviation of images of the respective colors.

When high-definition printing is required, by devising ideas, such as reducing the moving speed of the moving unit 550, it is possible to obtain positional accuracy of 50 μm to 100 μm, 10 μm to 30 μm, and the like.

The moving unit 550 is provided with a mandrel 70 that is inserted into the inside of the can body 10 to support the can body 10. The can body 10 is formed into a cylindrical shape, includes an opening at one end portion and a closed end portion at the other side. The mandrel 70 is inserted into the inside of the can body 10 from the opening at the one end portion.

The mandrel 70 is formed into a cylindrical shape. Moreover, the mandrel 70 is disposed in a state of being laid (along the horizontal direction). Consequently, in the exemplary embodiment, the can body 10 is also disposed in the state of being laid.

Further, the moving unit 550 is provided with a rotation mechanism 551 that rotates the mandrel 70 in the circumferential direction. The rotation mechanism 551 is provided with a mandrel motor, and, in the exemplary embodiment, the mandrel 70 is rotated by use of a driving force generated by the mandrel motor. Note that the rotation of the mandrel 70 is not limited to a configuration to directly rotate the mandrel 70 by the mandrel motor; the rotation may be carried out by belt driving. In other words, the mandrel 70 may be rotated by supplying a rotational driving force from a circularly moving belt to the mandrel 70.

Further, in this configuration example, when the moving unit 550 moves in the first linear unit 610, the mandrel 70 is placed closer to a region 1X side, which is one of two regions 1X and 1Y that face each other across the first linear unit 610. Moreover, in the configuration example, one mandrel 70 is installed in each moving unit 550.

Note that, in each of the moving units 550, plural mandrels 70, for example, two mandrels 70, may be installed. When the plural mandrels 70 are installed in each moving unit 550, plural inkjet heads 11 are also installed for each color.

In this manner, by installing the plural mandrels 70 and the plural inkjet heads 11, it is possible to increase the number of can bodies 10 on which printing can be performed per unit time.

Here, when the plural mandrels 70 are to be installed, the mandrels 70 may be installed so that, for example, the bottom portion of the can body 10 on the mandrel 70 is oriented in each of the above-described two regions 1X and 1Y. Moreover, the mandrel 70 may be installed so that, for example, the bottom portion of the can body 10 is oriented in only one of the two regions 1X and 1Y.

Note that, by installing the mandrel 70 in only one of the two regions 1X and 1Y, than by installing the mandrels 70 so that the mandrel 70 is oriented in each of the regions 1X and 1Y, each of the functional units, such as the can body loading unit 510, the printing unit 520, the drying unit 530 and the can body discharge unit 540, can be arranged closer to the one of the regions; therefore, it becomes easier to perform maintenance of each functional unit.

Moreover, when the plural mandrels 70 are provided to the respective moving units 550, the mandrel motor may be provided to each of the mandrels 70, or it may be possible to provide one mandrel motor to each of the moving units 550 and to supply the driving force from the mandrel motor to each of the mandrels 70.

Further, power supply to the mandrel motor installed to each of the moving units 550 can be performed by, for example, installing a power source rail along the moving route of the moving unit 550, and further, providing a current collector (current collector shoe) brought into contact with the power source rail to the moving unit 550.

Moreover, power supply to the mandrel motor installed to each of the moving units 550 may be performed by mounting a battery, which is an example of the power source, to each of the moving units 550, to thereby supply the power to the mandrel motor.

Further, in the exemplary embodiment, the can body loading unit 510, the printing unit 520, the drying unit 530 and the can body discharge unit 540 are disposed in the first linear unit 610.

Here, it is possible to consider a mode in which the printing apparatus 500 is provided with a curved unit having curvature, and the can body loading unit 510, the printing unit 520, the drying unit 530 and at least a part of the can body discharge unit 540 are installed to the curved unit; however, in this case, the printing apparatus 500 is likely to be upsized.

In contrast thereto, as in the exemplary embodiment, by installing the can body loading unit 510, the printing unit 520, the drying unit 530, the can body discharge unit 540, and the like to a linear unit, such as the first linear unit 610, it becomes possible to provide the functional units in proximity to one another, and to downsize the printing apparatus 500.

Further, providing the linear unit also increases a degree of flexibility in newly installing another functional unit or a degree of flexibility in uninstalling a functional unit. Moreover, in the linear unit, it becomes easy to control the position of the moving unit 550.

Moreover, in the exemplary embodiment, description was given by taking a case in which four functional units, namely, the can body loading unit 510, the printing unit 520, the drying unit 530 and the can body discharge unit 540 are provided as an example; however, other functional units may further be provided. Specifically, for example, between the can body loading unit 510 and the printing unit 520, an abnormality detection unit and an abnormal product discharge unit may be provided.

The abnormality detection unit detects abnormality in the shape of the can body, abnormality such as a flaw or a dent, or abnormality in mounting the can body 10 to the mandrel 70. In the abnormal product discharge unit, a can body 10 in which abnormality is detected is detached from the mandrel 70.

Further, in the exemplary embodiment, the moving unit 550 passes through a region positioned below the plurally provided inkjet heads 11.

Further, the moving unit 550 stops every time the moving unit 550 reaches below each inkjet head 11. Further, in the exemplary embodiment, the mandrel motor is driven to rotate the mandrel 70 in the circumferential direction. Further, ejection of ink from the inkjet head 11 is performed.

Then, when the mandrel 70 rotates 360° after ejection of ink is started, ejection of ink is stopped. Consequently, an image is formed on the outer circumferential surface of the can body 10.

Note that the mandrel 70 may be rotated every time the mandrel 70 reaches below each inkjet head 11, or the mandrel 70 may be continuously rotated during a period from the start of the moving unit 550 from the can body loading unit 510 to reaching the can body discharge unit 540.

Moreover, in the exemplary embodiment, the mandrel 70 is disposed sideways. Specifically, the mandrel 70 is disposed along the direction perpendicular to (crossing) the moving direction of the moving unit 550. In other words, in the exemplary embodiment, the can body 10 is conveyed in the state in which an axial direction of the can body 10 is perpendicular to (crossing) the moving direction of the moving unit 550.

In such a case, as compared to a case in which the mandrel 70 is disposed along the moving direction of the moving unit 550, it is possible to reduce a length L of the printing apparatus 500. In other words, it is possible to reduce the full length of the moving route on which the moving unit 550 moves.

Then, in this case, it is possible to reduce the production costs of the printing apparatus 500. In the case of the printing device 500 that performs printing in the course of moving the can body 10, the production costs are likely to be increased corresponding to the length of the moving route of the can body 10. In particular, in the case of conveyance using the linear mechanism, the production costs are increased.

As in the exemplary embodiment, in the case in which the mandrel 70 is disposed sideways, it is possible to reduce the moving route of the moving unit 550, to thereby reduce the production costs of the printing apparatus 500.

Moreover, by disposing the mandrel 70 sideways, it is possible to increase disposition density of the moving units 550 in the moving direction of the moving units 550, to thereby increase the number of the moving units 550 that can be installed.

Moreover, in the exemplary embodiment, the inkjet heads 11 are disposed above the can bodies 10, and the ink is ejected to the can bodies 10 from above.

In this case, as compared to a case in which the inkjet heads 11 are disposed at the lateral side of the can bodies 10 or below the can bodies 10, it is possible to reduce the effect of gravity acting on ink droplets ejected from the inkjet heads 11, to thereby increase accuracy of ink adhesive positions in the can body 10.

To the can body loading unit 510, the can body 10, on which printing has not yet been performed, are sequentially conveyed by a not-shown conveyance mechanism. Then, the can body 10 is pushed toward the mandrel 70 provided to the moving unit 550 (not shown in the figure) (pushed by a not-shown pushing mechanism), and thereby the mandrel 70 is inserted into the can body 10. Consequently, support of the can body 10 by the mandrel 70 is started.

Note that, in the can body loading unit 510, suction of air inside the mandrel 70 is performed on a rear end portion side of the mandrel 70 (on an end portion side opposite to the leading end portion on which insertion into the can body 10 is started), and when the can body 10 is mounted onto the mandrel 70, the can body 10 is sucked by the mandrel 70.

Moreover, in the can body discharge unit 540, by use of a not-shown air supply device, compressed air is supplied to the inside of the mandrel 70 from the rear end portion side of the mandrel 70. Consequently, the can body 10 is pushed by the compressed air and the can body 10 is detached from the mandrel 70. Note that the can body 10 detached from the mandrel 70 is conveyed to the next process by a not-shown conveyance mechanism.

Moreover, in the exemplary embodiment, the printing unit 520 is provided to the first linear unit 610. If the printing unit 520 is provided to the curved unit, not the linear unit such as the first linear unit 610, positions of the can bodies 10 with respect to the inkjet heads 11 are likely to be changed. In such a case, there is a possibility that quality of the image to be formed is deteriorated.

In contrast thereto, by providing the printing unit 520 to the first linear unit 610, image formation onto the can body 10 is performed in the course of linear movement of the moving unit 550. In this case, positions of the can bodies 10 with respect to the inkjet heads 11 are less likely to be changed, and therefore, it is possible to suppress deterioration of quality of images to be formed on the can bodies 10.

When the can body 10 is discharged at the can body discharge unit 540, there is provided a state in which the can body 10 is not placed on the moving unit 550. Then, the moving unit 550 on which the can body 10 is not placed reaches the first moving mechanism 710, and conveyed to the second linear unit 620 by the first moving mechanism 710. Thereafter, the moving unit 550 reaches the second moving mechanism 720 after traveling the second linear unit 620. Then, the moving unit 550 returns to the first linear unit 610 by the second moving mechanism 720.

Figure 2:
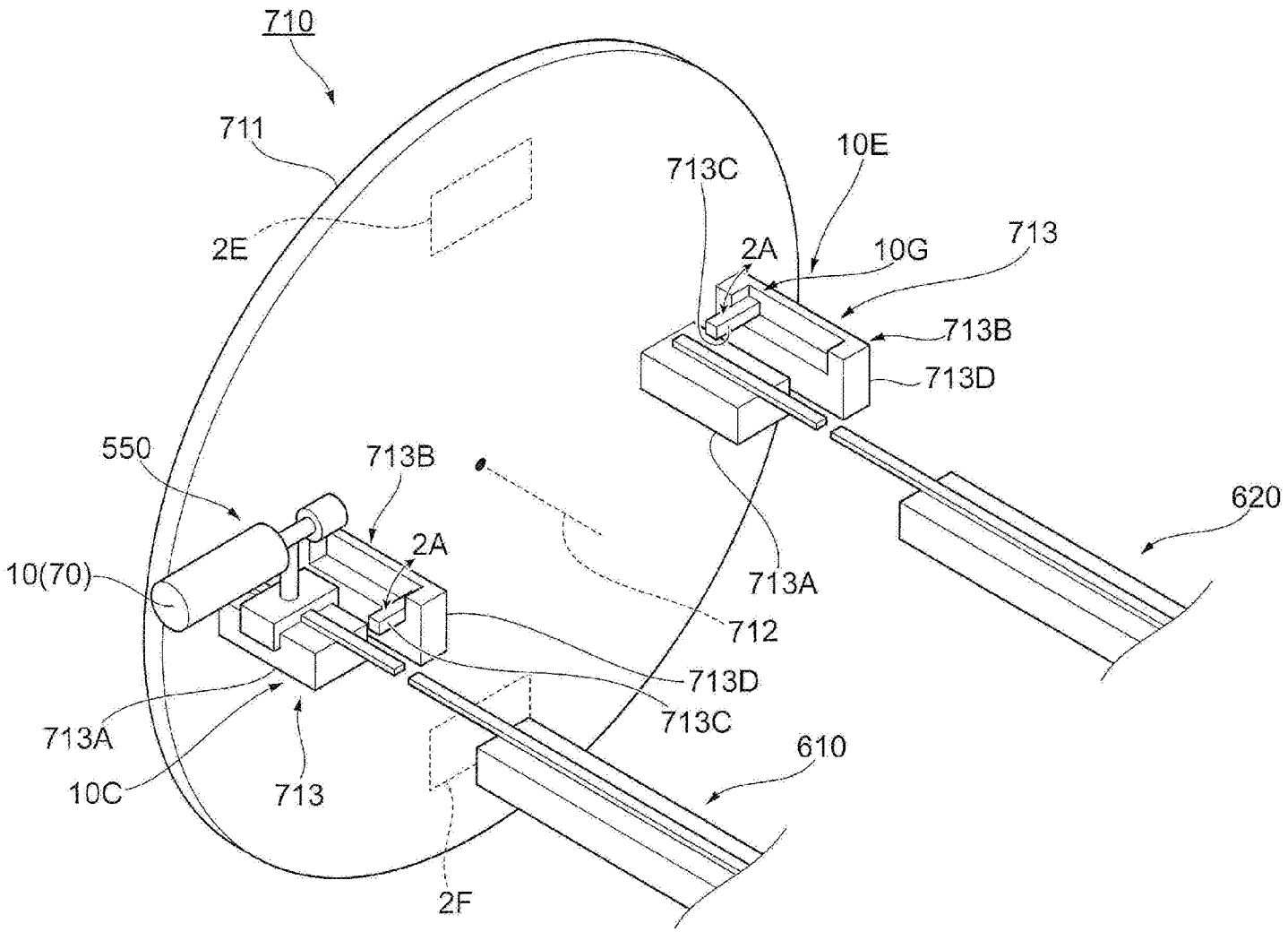
FIG. 2 is a diagram showing a configuration of a first moving mechanism.

FIG. 2 is a diagram showing a configuration of the first moving mechanism 710. Note that the second moving mechanism 720 is configured in the same way as the first moving mechanism 710.

The first moving mechanism 710 as an example of a moving mechanism includes a rotation disk 711 as an example of a rotation body rotated by a not-shown motor. Note that, though the rotation disk 711 is formed into a circular disk shape, the shape is not limited to the circular disk, and the rotation disk 711 may be formed into other shapes, such as a polygon.

The rotation disk 711 rotates around a rotation axis 712 along the horizontal direction. Moreover, onto a side surface, of the rotation disk 711, on the first linear unit 610 side and the second linear unit 620 side, two unit support mechanisms 713 are attached. The rotation disk 711 holds the moving units 550 by use of the unit support mechanisms 713. Then, the rotation disk 711 rotates, for example, in the clockwise direction in the figure while holding the moving units 550.

Each of the unit support mechanisms 713 is provided with a support base 713A that supports the moving unit 550 from below. Further, each of the unit support mechanisms 713 is provided with a unit moving mechanism 713B that moves the moving unit 550.

On the downstream side of the first linear unit 610, the unit moving mechanism 713B moves the moving unit 550 toward the support base 713A, the moving unit 550 having moved on the first linear unit 610.

Moreover, on the upstream side of the second linear unit 620, the unit moving mechanism 713B moves the moving unit 550 on the support base 713A toward the second linear unit 620.

Each of the unit moving mechanisms 713B is provided with a pressing member 713C that presses the moving unit 550. Further, there is provided a pressing member moving mechanism 713D that moves the pressing member 713C.

The pressing member moving mechanism 713D moves the pressing member 713C in a direction in which the rotation axis 712 of the rotation disk 711 extends. Moreover, as indicated by an arrow 2A in the figure, the pressing member moving mechanism 713D moves the pressing member 713C forward and backward with respect to the moving route of the moving unit 550.

The pressing member moving mechanism 713D is provided with, for example, a circulating belt (not shown in the figure) installed to extend along the direction in which the rotation axis 712 of the rotation disk 711 extends, onto an outer circumferential surface of which the pressing member 713C is attached. Moreover, the pressing member moving mechanism 713D is provided with a motor that rotates the circulating belt.

In the exemplary embodiment, the motor is rotated to circulate the circulating belt, and accordingly, the pressing member 713C is moved in the direction in which the rotation axis 712 of the rotation disk 711 extends.

Further, the pressing member 713C is attached to the circulating belt via, for example, a solenoid, and by switching on and off the solenoid, the pressing member 713C moves forward and backward with respect to the moving route of the moving unit 550.

When the moving unit 550 that has been moved on the first linear unit 610 is placed on the support base 713A, as indicated by a reference sign 10C, the unit support mechanism 713 is kept on standby on an extended line of the first linear unit 610. Moreover, on this occasion, the pressing member 713C is retracted from the moving route of the moving unit 550.

Then, after the moving unit 550, which had been moved from the upstream side, passed through the pressing member 713C, the pressing member 713C is caused to move forward onto the moving route of the moving unit 550.

Subsequently, the pressing member 713C is moved in the direction that approaches the rotation disk 711. Consequently, the moving unit 550 is moved by being pressed by the pressing member 713C, and thereby the moving unit 550 is placed on the support base 713A.

Thereafter, the rotation disk 711 is rotated 180° in the clockwise direction in the figure, and, as indicated by the reference sign 10E, the support base 713A on which the moving unit 550 is placed is moved onto the extended line of the second linear unit 620.

Thereafter, the pressing member 713C indicated by a reference sign 10G is moved toward the second linear unit 620. Consequently, the moving unit 550 comes to be heading for the second linear unit 620 to be placed on the second linear unit 620.

Note that, in the exemplary embodiment, in the middle of moving the moving unit 550 from the extended line of the first linear unit 610 to the extended line of the second linear unit 620, the pressing member 713C is moved.

Specifically, when the moving unit 550 is positioned on the extended line of the first linear unit 610, the pressing member 713C is positioned on a side closer to the first linear unit 610 and the second linear unit 620.

Then, in the exemplary embodiment, in the middle of moving the moving unit 550 to the extended line of the second linear unit 610, the pressing member 713C is moved in a direction away from the first linear unit 610 and the second linear unit 620.

More specifically, to avoid interference between the pressing member 713C and the moving unit 550, the pressing member 713C is temporarily retracted from the moving route of the moving unit 550, and thereafter, the pressing member 713C is moved in the direction away from the first linear unit 610 and the second linear unit 620.

Then, when movement of the pressing member 713C is completed, the pressing member 713C is projected again onto the moving route of the moving unit 550. Consequently, as indicated by the reference sign 10G, the pressing member 713C is positioned on the rotation disk 711 side, and accordingly, it becomes possible to press the moving unit 550 against the second linear unit 620, which will be performed thereafter.

Subsequently, the pressing member 713C is moved so that the pressing member 713C approaches the second linear unit 620. Consequently, the moving unit 550 is pressed by the pressing member 713C, to thereby reach the second linear unit 620. Thereafter, in the second linear unit 620, similar to the first linear unit 610, the moving unit 550 is moved by the linear mechanism.

Then, when the moving unit 550 reaches the second moving mechanism 720, the moving unit 550 is moved by the second moving mechanism 720, and thereby, the moving unit 550 is moved to the first linear unit 610.

Then, the moving unit 550 that has reached the first linear unit 610 is moved along the first linear unit 610. Then, in the course of the moving, mounting of the can body 10 to the moving unit 550, printing onto the can body 10, curing of the image and discharge of the can body 10 are performed again.

In other words, in the printing apparatus 500 of the exemplary embodiment, the moving unit 550 performs circulating movement; in the middle of performing the circulating movement, mounting of the can body 10 to the moving unit 550, printing onto the can body 10, curing of the image and discharge of the can body 10 are performed.

It is also possible to move the moving unit 550 by use of a moving mechanism (to be described later) in which the support base 713A performs reciprocating motion; however, in this case, moving efficiency of the moving unit 550 is likely to be deteriorated.

In the configuration example shown in FIG. 2, the reciprocating motion is not performed, and the moving unit 550 is moved by rotation of the rotation disk 711 in one direction. In such a case, as compared to the case in which the support base 713A performs reciprocating movement, it is possible to increase moving efficiency of the moving unit 550.

Note that, in the configuration example shown in FIG. 2, description was given of a case in which two unit support mechanisms 713 are provided; however, the number of unit support mechanisms 713 is not limited to two, and three or more unit support mechanisms 713 may be installed.

Specifically, the unit support mechanisms 713 can be installed at locations indicated by reference signs 2E and 2F and the like in FIG. 2; in this case, four unit support mechanisms 713 are provided.

In FIG. 2, by installing the unit support mechanisms 713 also at the locations indicated by the reference signs 2E and 2F, the moving unit 550 can be moved to the second linear unit 620 by every quarter revolution of the rotation disk 711 in the normal operation state, and there is the advantage of attaining movement in a short time.

Figure 3:
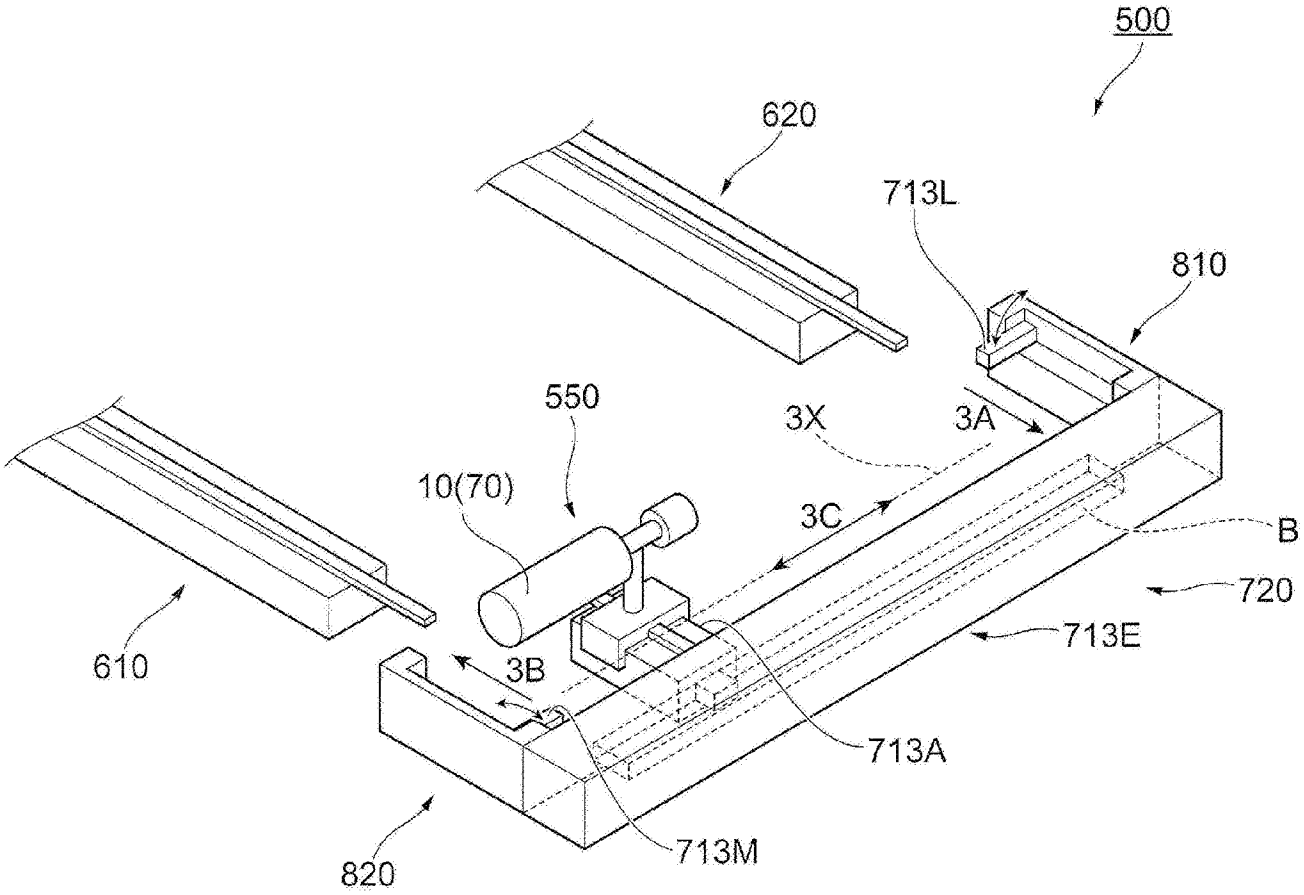
FIG. 3 is a diagram showing another configuration example of the first moving mechanism and a second moving mechanism.

FIG. 3 is a diagram showing another configuration example of the first moving mechanism 710 and the second moving mechanism 720. Note that, in FIG. 3, the second moving mechanism 720 is shown; however, the first moving mechanism 710 is also configured in the same way.

The second moving mechanism 720 is provided with: the support base 713A that supports the moving unit 550 from below; and a support base moving mechanism 713E that moves the support base 713A in the direction indicated by an arrow 3C in the figure to cause the support base 713A to perform reciprocal movement.

The support base moving mechanism 713E is configured with, for example, a belt member B to which the support base 713A is attached for performing circulating movement and a belt motor (not shown) that rotates the belt member B.

Note that the support base 713A may be moved by use of a cylinder, such as an air cylinder, not limited to the belt member B. Moreover, it may be possible to install a circularly moving chain instead of the belt member B, to thereby move the support base 713A by the chain.

Further, the second moving mechanism 720 is provided with a first pressing member 713L and a second pressing member 713M that press, similar to the above, the moving unit 550 to move thereof.

Further, similar to the above, there is provided a first moving mechanism 810 that moves the first pressing member 713L and a second moving mechanism 820 that moves the second pressing member 713M.

Similar to the above-described unit moving mechanism 713B (refer to FIG. 2), the first moving mechanism 810 moves the first pressing member 713L in the direction in which the second linear unit 620 extends. Moreover, the first moving mechanism 810 moves the first pressing member 713L forward and backward with respect to the moving route of the moving unit 550.

Moreover, the second moving mechanism 820 moves the second pressing member 713M in the direction in which the first linear unit 610 extends. Moreover, the second moving mechanism 820 moves the second pressing member 713M forward and backward with respect to the moving route of the moving unit 550.

In this configuration example, also, when the moving unit 550, which had traveled the second linear unit 620 and moved, passed beside the first pressing member 713L, the first pressing member 713L is moved forward onto the moving route of the moving unit 550.

Thereafter, the first pressing member 713L is moved in the direction indicated by an arrow 3A in the figure. The moving unit 550 is pressed by the first pressing member 713L, to thereby similarly move in the direction indicated by the arrow 3A. At this time, the support base 713A is on standby on the downstream side in the moving direction of the moving unit 550, and the moving unit 550 is placed onto the support base 713A.

Subsequently, in the exemplary embodiment, the support base moving mechanism 713E is driven, and thereby, the moving unit 550 on the support base 713A linearly moves from the side on which the second linear unit 620 is provided to the side on which the first linear unit 610 is provided. Then, the moving unit 550 reaches the upstream side of the first linear unit 610 and is stopped.

Here, in the exemplary embodiment, when the moving unit 550 moves from second linear unit 620 side to the first linear unit 610 side, the moving unit 550 moves linearly.

To additionally describe, in this case, the moving unit 550 moves along a linear moving route heading from the second linear unit 620 side toward the first linear unit 610 side (the moving route indicated by a reference sign 3X in the figure) (hereinafter, referred to as "third moving route 3X").

Here, the third moving route 3X is substantially orthogonal to a moving route when the moving unit 550 moves along the first linear unit 610 (the first moving route) and a moving route when the moving unit 550 moves along the second linear unit 620 (the second moving route).

Here, if the third moving route 3X is not orthogonal to the first moving route and the second moving route, as compared to the case of being orthogonal, the occupation area of the printing apparatus 500 is increased.

Note that the same is true for the first moving mechanism 710; the moving route, which the moving unit 550 moved by the first moving mechanism 710 travels, is orthogonal to the first moving route and the second moving route.

Thereafter, in this configuration example, the second pressing member 713M is moved in the direction indicated by an arrow 3B, and the moving unit 550 on the support base 713A is pressed by the second pressing member 713M. Consequently, the moving unit 550 heads for the first linear unit 610 to be placed on the first linear unit 610. Thereafter, the moving unit 550 is moved to the downstream side along the first linear unit 610.

After pressing the moving unit 550, the first pressing member 713L and the second pressing member 713M return to the original locations.

Note that, in the support base moving mechanism 713E, the support base 713A is moved by use of the belt member B that performs circulating movement and the belt motor that rotates the belt member B; however, not limited thereto, the support base 713A may be moved by use of a cylinder, such as an air cylinder.

Moreover, it may be possible to install a circularly moving chain instead of the belt member, to thereby move the support base 713A by the chain.

Moreover, as shown in FIGS. 2 and 3, movement of the moving unit 550 to the support base 713A was performed by use of the pressing member 713C (refer to FIG. 2), the first pressing member 713L (refer to FIG. 3) and the second pressing member 713M (refer to FIG. 3); however, without using these pressing members, the moving unit 550 may be moved onto the support base 713A by using inertia force of the moving unit 550.

Specifically, it may be possible that the moving unit 550 having been moved along the first linear unit 610 and the second linear unit 620 is not stopped, but is moved onto the support base 713A as-is, to thereby place the moving unit 550 on the support base 713A.

Figure 4:
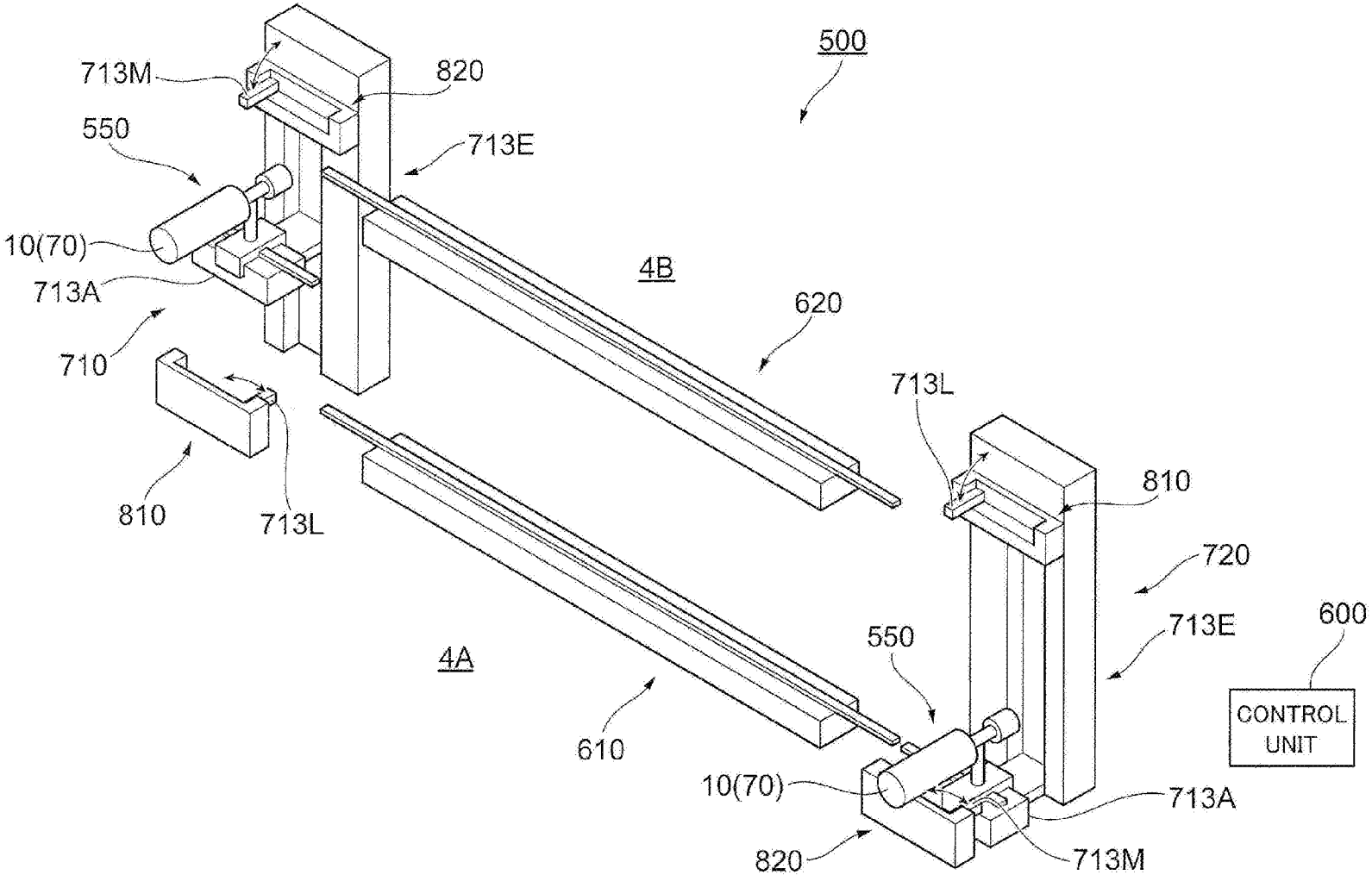
FIG. 4 is a diagram showing another configuration example of the printing apparatus.

FIG. 4 is a diagram showing another configuration example of the printing apparatus 500. Note that, in FIG. 4, illustration of the can body loading unit 510, the printing unit 520, the drying unit 530 and the can body discharge unit 540 is omitted.

In the configuration example shown in FIG. 3, on a single horizontal surface, there are provided the first linear unit 610, the second linear unit 620, the first moving mechanism 710 and the second moving mechanism 720.

In contrast thereto, in the configuration example shown in FIG. 4, the positions of the first linear unit 610 and the second linear unit 620 are different in the vertical direction, and the second linear unit 620 is positioned above the first linear unit 610 (above the first linear unit 610 in the vertical direction).

In other words, in the configuration example shown in FIG. 3, the first linear unit 610 and the second linear unit 620 are disposed in a planar fashion; however, in the configuration example shown in FIG. 4, the first linear unit 610 and the second linear unit 620 are disposed three-dimensionally.

To describe further, in the configuration example shown in FIG. 4, the first linear unit 610 and the second linear unit 620 are disposed in multiple stages.

Then, in the configuration example shown in FIG. 4, the first moving mechanism 710 conveys the moving unit 550 upwardly, and thereby the moving unit 550 that has been moved through the first linear unit 610 is moved to the second linear unit 620.

Moreover, the second moving mechanism 720 conveys the moving unit 550 downwardly, and thereby the moving unit 550 that has been moved through the second linear unit 620 is moved to the first linear unit 610.

In the configuration example shown in FIG. 3, the first linear unit 610, the second linear unit 620, the first moving mechanism 710 and the second moving mechanism 720 are disposed on a single surface along the horizontal direction, and the occupation area of the printing apparatus 500 is likely to be increased.

In contrast thereto, in the configuration example shown in FIG. 4, the printing apparatus 500 is disposed three-dimensionally, and therefore, the occupation area of the printing apparatus 500 is reduced.

Further, in the configuration example shown in FIG. 4, as compared to the configuration example shown in FIG. 3, it becomes easier to perform maintenance of the printing apparatus 500.

In the configuration example shown in FIG. 3, the printing apparatus 500 is formed into an annular shape (the moving route of the moving unit 550 has an annular shape), and, when maintenance of the printing apparatus 500 is performed, a person performing the maintenance is required to circularly move around the printing apparatus 500 to perform the maintenance.

In contrast thereto, in the configuration example shown in FIG. 4, it is possible to perform the maintenance without doing the circular movement. Moreover, in the configuration example shown in FIG. 4, the maintenance can be performed from both sides, namely, the region side indicated by a reference sign 4A and the region side indicated by a reference sign 4B; therefore, the maintenance can be performed with ease in this point, too.

In the configuration example shown in FIG. 3, the printing apparatus 500 is formed into the annular shape, and accordingly, it is difficult to perform the maintenance from inside of the printing apparatus 500.

Note that each of the first moving mechanism 710 and the second moving mechanism 720 is provided with the support base 713A that supports the moving unit 550 from below and the support base moving mechanism 713E that vertically moves the support base 713A.

Further, each of the first moving mechanism 710 and the second moving mechanism 720 is provided with the first pressing member 713L and the second pressing member 713M that press the moving unit 550 to move thereof.

Further, similar to the above, each of the first moving mechanism 710 and the second moving mechanism 720 is provided with the first moving mechanism 810 that moves the first pressing member 713L and the second moving mechanism 820 that moves the second pressing member 713M.

In this configuration example, also, when the moving unit 550 passes through the first linear unit 610 (when printing onto the can body 10 is finished), the moving unit 550 passes beside the first pressing member 713L provided to the first moving mechanism 710.

Thereafter, the first pressing member 713L is moved forward onto the moving route of the moving unit 550. Thereafter, the moving unit 550 is pressed by the first pressing member 713L to be placed on the support base 713A.

Subsequently, in the exemplary embodiment, the support base moving mechanism 713E of the first moving mechanism 710 is driven, to thereby move the support base 713A upwardly. Then, when the support base 713A reaches the extended line of the second linear unit 620, the support base 713A is stopped. At this time, the second pressing member 713M of the first moving mechanism 710 is positioned on a side away from the second linear unit 620.

Thereafter, the second pressing member 713M is moved toward the second linear unit 620 side, and the moving unit 550 is pressed by the second pressing member 713M. Consequently, the moving unit 550 heads for the second linear unit 620 and is supported by the second linear unit 620.

Thereafter, the moving unit 550 is moved along the second linear unit 620 and reaches the second moving mechanism 720. Then, the moving unit 550 passes beside the first pressing member 713L of the second moving mechanism 720. Subsequently, the first pressing member 713L is moved forward onto the moving route of the moving unit 550, and further, presses the moving unit 550. This causes the moving unit 550 to be placed onto the support base 713A.

Thereafter, the support base 713A is lowered to reach the extended line of the first linear unit 610. Thereafter, the second pressing member 713M of the second moving mechanism 720 presses the moving unit 550. Consequently, the moving unit 550 heads for the first linear unit 610. Thereafter, the moving unit 550 is moved to the downstream side along the first linear unit 610.

Here, in the configuration examples shown in FIGS. 1, 3 and 4, the moving unit 550 that has been moved along the first linear unit 610 is moved in a lateral direction or is moved upwardly, and thereby the moving unit 550 is moved to the second linear unit 620.

Similarly, the moving unit 550 that has been moved along the second linear unit 620 is moved in a lateral direction or is moved downwardly, and thereby the moving unit 550 is moved to the first linear unit 610.

In the lateral movement or the vertical movement, in the exemplary embodiment, the moving unit 550 is moved by a mechanism other than the linear mechanism.

Printing is not performed at locations other than the first linear unit 610, and therefore, positional accuracy of the moving unit 550 is not required so much. In such a case, if the moving unit 550 is moved by a mechanical section other than the linear mechanism, inconvenience is not likely to occur. Moreover, by using a mechanism other than the linear mechanism, the printing apparatus 500 becomes less expensive.

Figure 5:
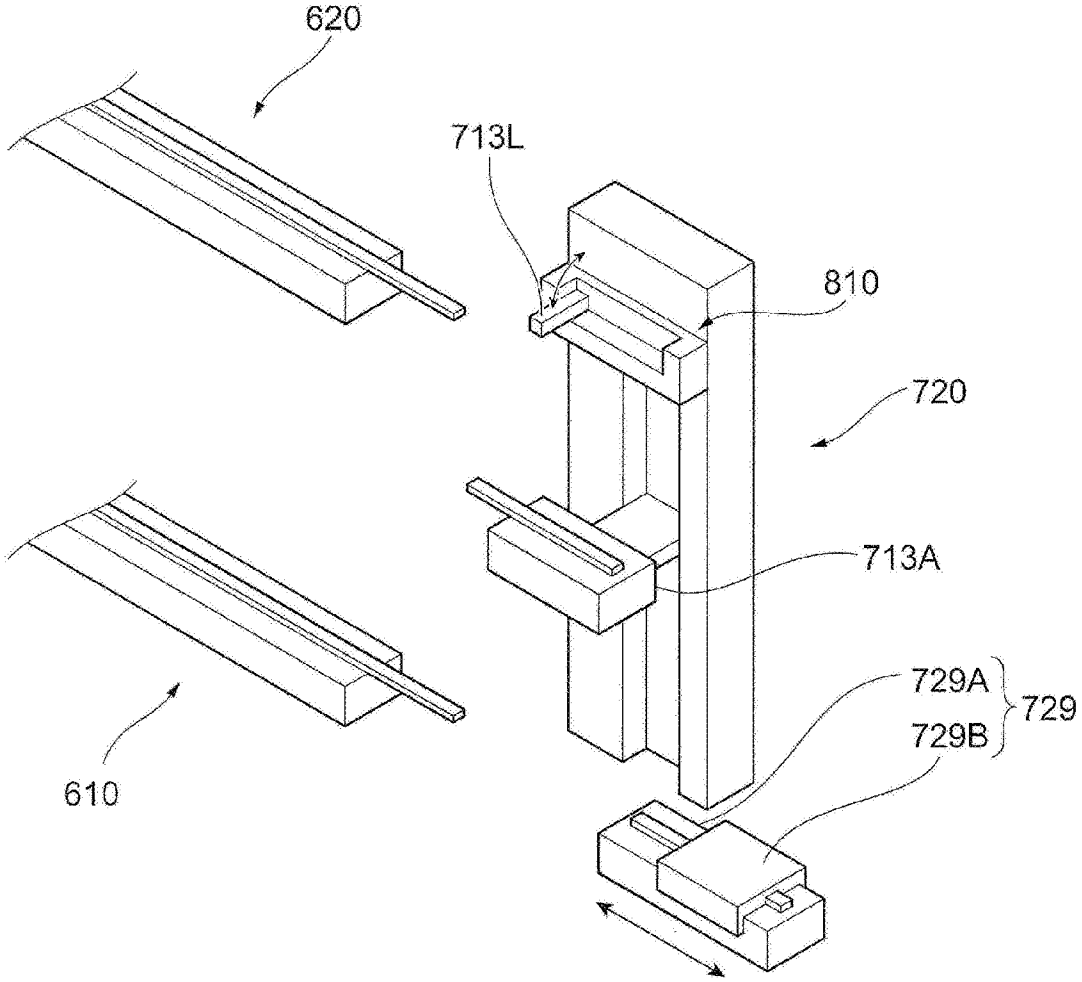
FIG. 5 is a diagram showing another configuration example of the second moving mechanism.

FIG. 5 is a diagram showing another configuration example of the second moving mechanism 720. Note that the first moving mechanism 710 is configured in the same way as the second moving mechanism 720.

In the configuration examples described in the above, when the moving unit 550, which has moved toward the first linear unit 610 or the second linear unit 620, was pressed, the pressing member pressed the moving unit 550.

In contrast thereto, in the configuration example shown in FIG. 5, the moving unit 550 is pressed by a reciprocating member 729 having a cross-sectional shape that closely resembles a cross-sectional shape of a base (to be described later) included in the moving unit 550, to thereby move the moving unit 550 to the first linear unit 610 or the second linear unit 620.

The reciprocating member 729 is, when the support base 713A is moved from above in FIG. 5, positioned on the right side of the support base 713A in the figure. Then, when the support base 713A is lowered and the moving unit 550 (not shown in FIG. 5) on the support base 713A is lowered to the same height as the first linear unit 610, the reciprocating member 729 is moved forward toward the moving unit 550. Consequently, the moving unit 550 is pressed by the reciprocating member 729, and is caused to head for the first linear unit 610.

Though illustration is omitted, on the first moving mechanism 710 side, the reciprocating member 729 is provided on the extended line of the second linear unit 620; therefore, on the first moving mechanism 710 side, the moving unit 550 is pressed by the reciprocating member 729, and the moving unit 550 heads for the second linear unit 620.

Moreover, the reciprocating member 729 is configured with two members, namely, a lower reciprocating member 729A and an upper reciprocating member 729B supported by the lower reciprocating member 729A, and, when the moving unit 550 is pressed, these two members are moved forward toward the moving unit 550.

Note that, in the configuration examples shown in FIGS. 1, 3 and 4, in both of the first linear unit 610 and the second linear unit 620, the moving unit 550 was moved by use of the linear mechanism.

By the way, moving of the moving unit 550 by use of the linear mechanism may be, for example, performed only in the first linear unit 610 provided with the printing unit 520, and, in the second linear unit 620, the moving unit 550 may be moved by use of a mechanism other than the linear mechanism.

Figure 6:
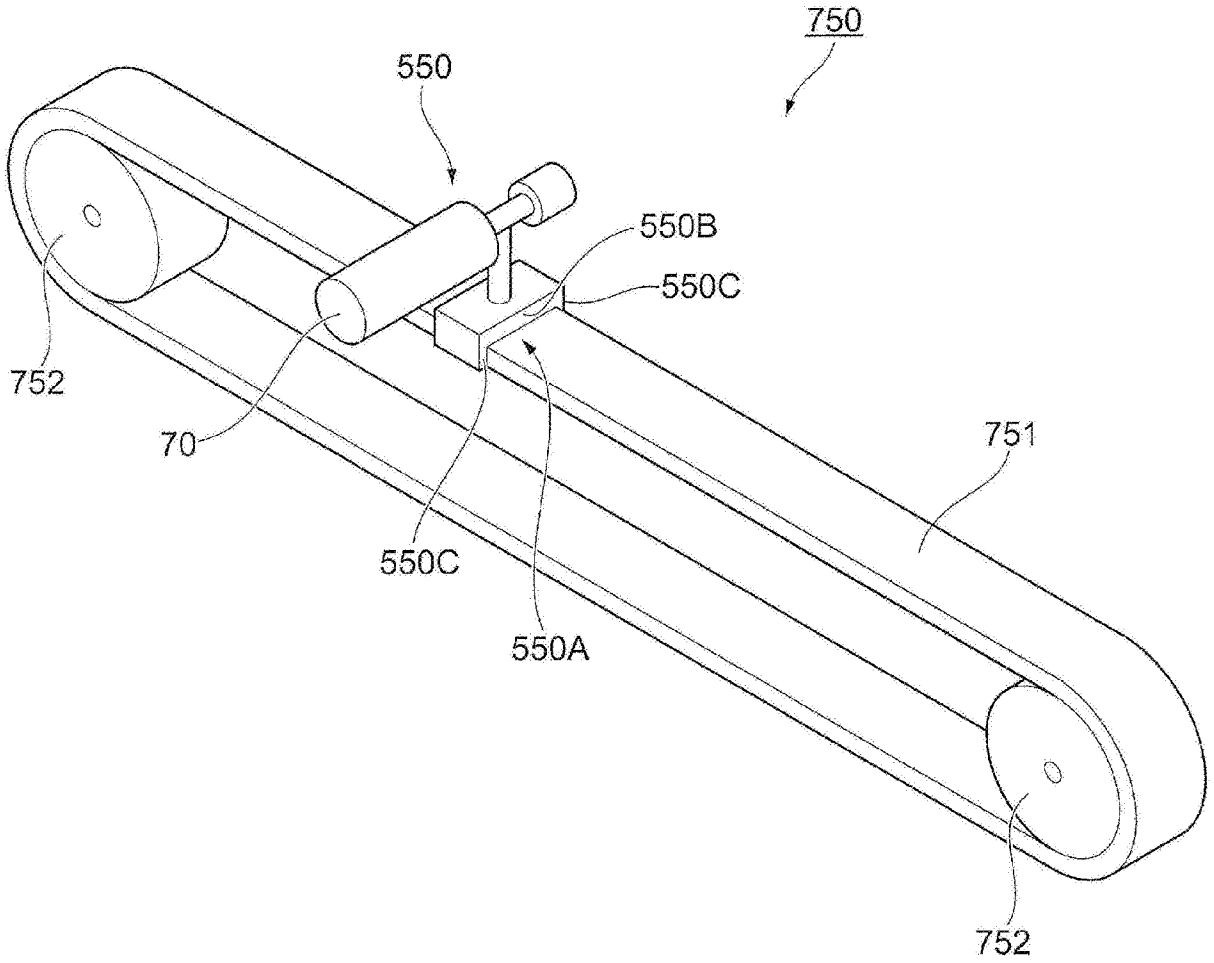
FIG. 6 is a diagram showing another configuration example of a mechanism that moves a moving unit.

For example, the moving unit 550 may be moved by use of a belt conveyance device 750 shown in FIG. 6 (a diagram showing another configuration example of a mechanism that moves the moving unit 550).

The belt conveyance device 750 is provided with a circulating belt 751 that circularly moves, tension rolls 752 that extend the circulating belt 751, and a drive motor (not shown in the figure) that rotates the tension rolls 752.

In this configuration example, when the moving unit 550 moves to the upstream side of the belt conveyance device 750, the moving unit 550 is placed onto the circulating belt 751. Then, the moving unit 550 is moved along with the movement of the circulating belt 751, and the moving unit 550 reaches an end portion of the belt conveyance device 750.

As shown in FIG. 6, the moving unit 550 in the exemplary embodiment is provided with a base 550A that supports the mandrel 70 or the like from below.

The base 550A is provided with a base main body 550B along the horizontal direction and two side wall portions 550C that extend downwardly from both end portions of the base main body 550B.

When the moving unit 550 is conveyed by the belt conveyance device 750, the circulating belt 751 enters the region surrounded by the base main body 550B and the two side wall portions 550C.

Note that, when the moving unit 550 is supported by the support base 713A shown in FIGS. 2, 4 and the like, the support base 713A also enters the above-described surrounded region. Moreover, when the moving unit 550 is supported by the guide member 561 (refer to FIG. 1) provided to the first linear unit 610 or the second linear unit 620, the guide member 561 also enters the surrounded region.

In the printing unit 520 or the like, it becomes necessary to accurately control the position of the moving unit 550; however, in the locations where the printing unit 520 is not provided, such as the second linear unit 620, control of the position may be performed moderately. In this case, it becomes possible to provide the belt conveyance device 750 in place of the linear mechanism.

Moreover, if the moving unit 550 is moved by use of the linear mechanism in both of the first linear unit 610 and the second linear unit 620, the manufacturing costs of the printing apparatus 500 are likely to be increased. In contrast thereto, by installing the belt conveyance device 750 in place of the linear mechanism, the manufacturing costs of the printing apparatus 500 become less expensive. Note that, other than this, the moving unit 550 may be moved by use of a cylinder, such as an air cylinder. Moreover, the moving unit 550 may be moved by a circularly moving chain or the like. In these cases, as compared to the case of using the linear mechanism, the manufacturing costs of the printing apparatus 500 become less expensive.

Note that, in the first moving mechanism 710 and the second moving mechanism 720 of the printing apparatus 500 shown in FIG. 3, movement of the moving unit 550 is performed by moving the support base 713A.

By the way, the mechanism that moves the moving unit 550 is not limited thereto; in any of the first moving mechanism 710 and the second moving mechanism 720, it may be possible to install the belt conveyance device 750 and place the moving unit 550 onto the circulating belt 751, to thereby move the moving unit 550.

FIGS. 7A to 7E, 8A and 8B are diagrams showing other configuration examples of the printing apparatus 500. Note that, in FIGS. 7 and 8, states in which the printing apparatus 500 is viewed from the lateral side are shown, where the upper side in the figure indicates the upper side in the vertical direction and the lower side in the figure indicates the lower side in the vertical direction.

Figure 7A:
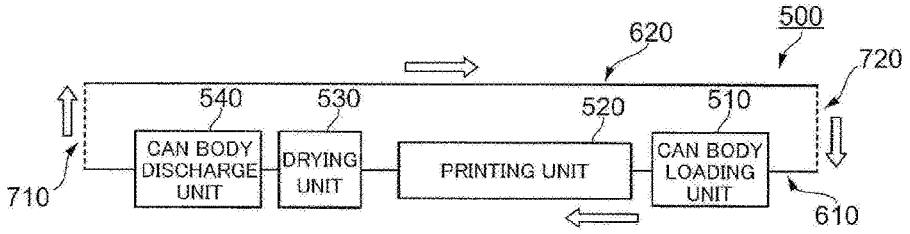
FIGS. 7A to 7E are diagrams showing other configuration examples of the printing apparatus.

FIG. 7A schematically shows the printing apparatus 500 shown in FIG. 4, in which the first linear unit 610 is provided with the can body loading unit 510, the printing unit 520, the drying unit 530 and the can body discharge unit 540. Moreover, the second linear unit 620 is provided above the first linear unit 610.

Figure 7B:
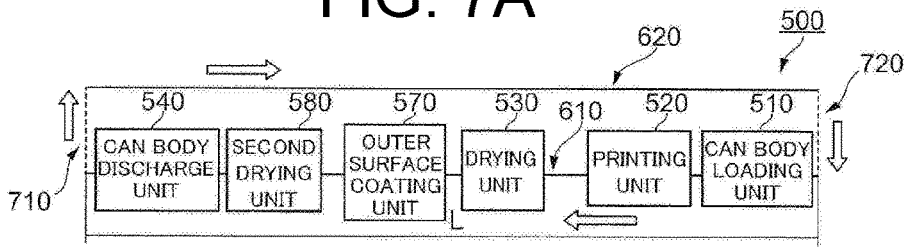

In the configuration example shown in FIG. 7B, the first linear unit 610 is provided with the can body loading unit 510, the printing unit 520, the drying unit 530, an outer surface coating unit 570, a second drying unit 580 and the can body discharge unit 540.

In the configuration example shown in FIG. 7A, there are provided the four functional units, namely, the can body loading unit 510, the printing unit 520, the drying unit 530 and the can body discharge unit 540; however, in the configuration example shown in FIG. 7B, in addition to the four functional units, the outer surface coating unit 570 and the second drying unit 580 are further provided.

The outer surface coating unit 570 coats the outer circumferential surface of the can body 10 with transparent paint, to thereby form a protection layer on the outer circumferential surface of the can body 10. The outer surface coating unit 570 is provided with a contact roll (to be described later) to be brought into contact with the outer circumferential surface of the can body 10, and the outer circumferential surface of the can body 10 is coated with paint by use of the contact roll to form the protection layer. The can body on which the protection layer is formed reaches the second drying unit 580, and the can body 10 is heated. Consequently, the protection layer is cured.

Figure 9B:
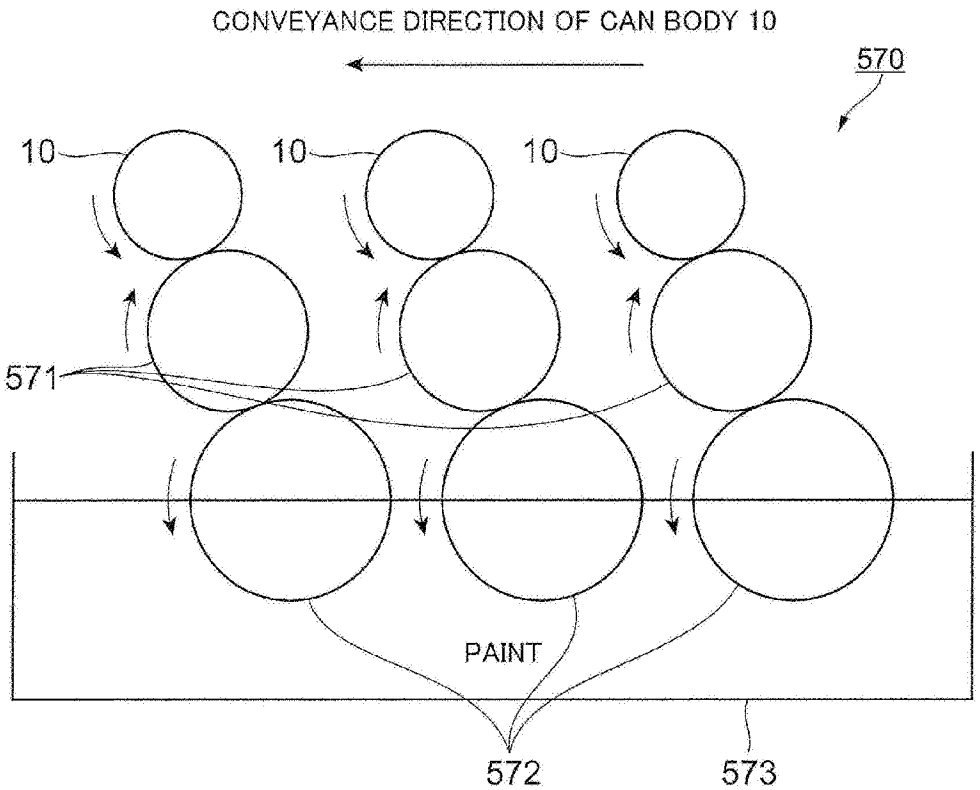
FIGS. 9A and 9B are schematic views showing configurations of an outer surface coating unit.
Figure 9A:
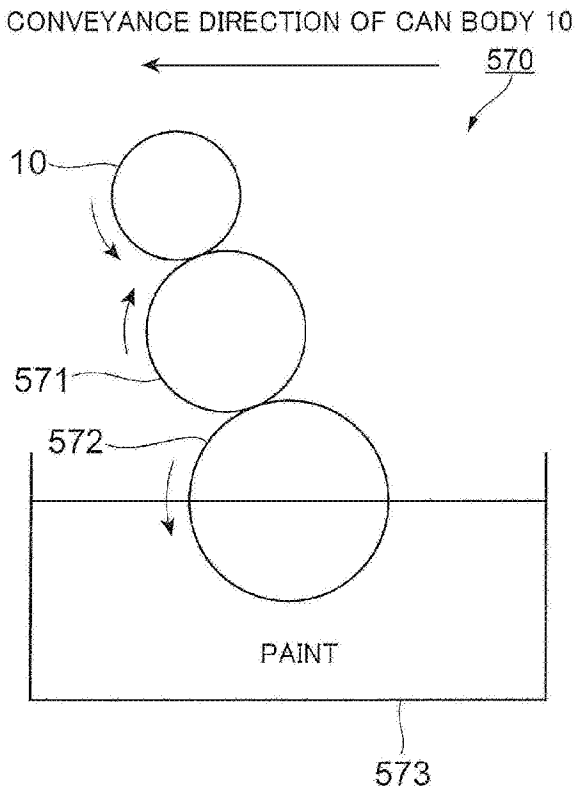
Figure 10B:
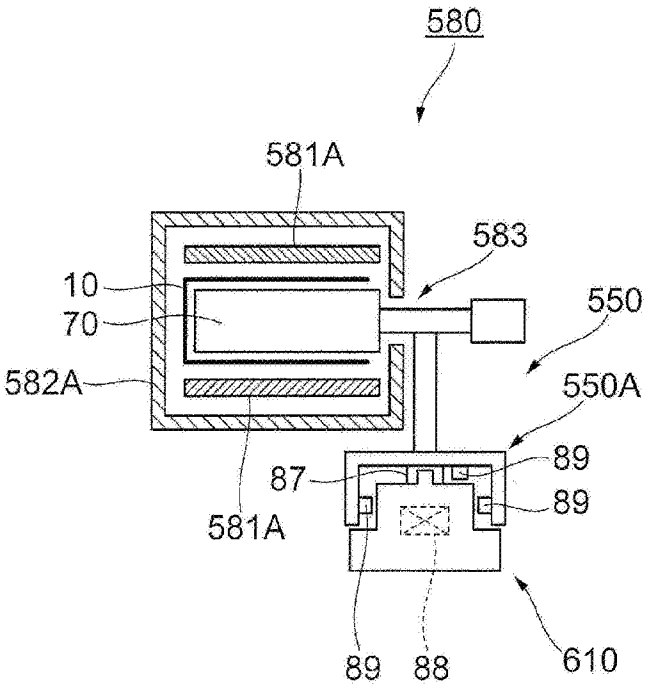
FIGS. 10A and 10B are diagrams showing a configuration of a second drying unit.
Figure 10A:
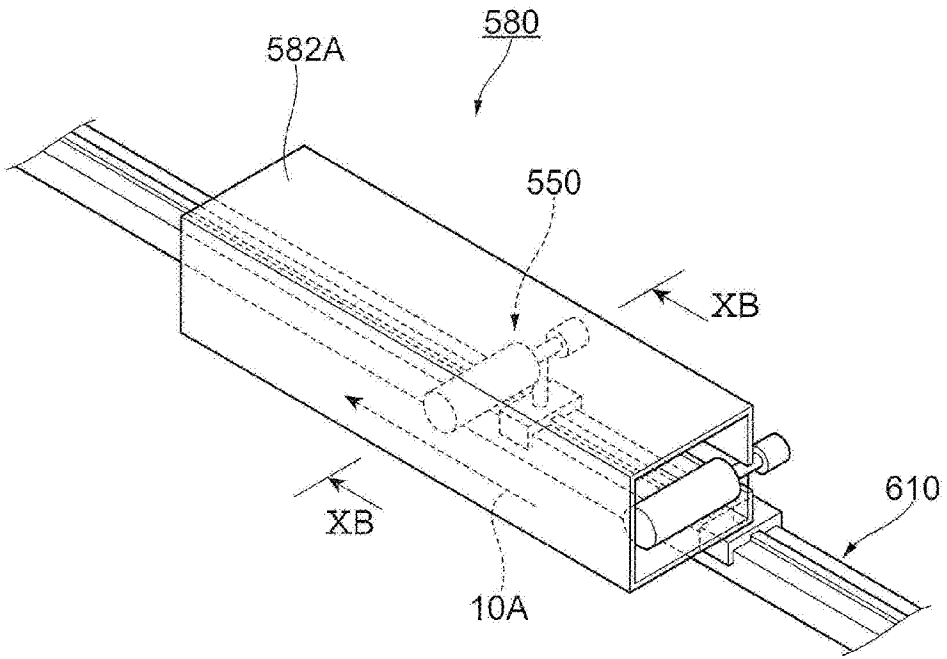

FIGS. 9A and 9B are schematic views showing configurations of the outer surface coating unit 570. FIGS. 10A and 10B are diagrams showing a configuration of the second drying unit 580.

As shown in FIG. 9A, the outer surface coating unit 570 is provided with: the contact roll 571 that is rotated while being in contact with the rotating can body 10; and a supply roll 572 that supplies the surface of the contact roll 571 with paint. Further, there is provided a container 573 that contains the paint.

In the exemplary embodiment, the paint in the container 573 is supplied to the contact roll 571 by the supply roll 572. Subsequently, the outer circumferential surface of the can body 10 is coated with the paint by the contact roll 571.

Note that the outer surface coating unit 570 shown in FIG. 9B will be described later.

FIG. 10A is a perspective view showing an overall configuration of the second drying unit 580. Moreover, FIG. 10B is a cross-sectional view of the second drying unit 580 on the line XB-XB in FIG. 10A.

As shown in FIG. 10B, the second drying unit 580 as an example of a heating unit is provided with infrared heaters 581A as heating sources. The infrared heaters 581A are installed at plural locations in the moving direction of the moving unit 550. Moreover, the infrared heaters 581A are installed at two locations, namely, above and below the can body 10.

Moreover, the second drying unit 580 is provided with a container housing 582A that contains the infrared heaters 581A to prevent heat from escaping to the outside, the container housing 582A having a rectangular-shaped cross section.

At a side wall of the container housing 582A, there is formed a through hole 583 in a elongate-hole shape along the moving direction of the moving unit 550, and a support axis that supports the mandrel 70 passes through the through hole 583 to reach the outside of the container housing 582A.

In the exemplary embodiment, when the moving unit 550 reaches the second drying unit 580, as shown in FIG. 10B, the can body 10 is contained in the container housing 582A.

Then, in this state, as indicated by an arrow 10A in FIG. 10A, the moving unit 10 is moving. During the process, the can body 10 is heated to cure the protection layer.

Note that, in the exemplary embodiment, as shown in FIG. 10B, a permanent magnet 87 is attached to the base 550A of the moving unit 550. Moreover, electromagnets 88 are installed at the first linear unit 610. Further, the base 550A of the moving unit 550 is provided with rotation rolls 89 that are rotatable to reduce slide resistance between the moving unit 550 and the first linear unit 610. In the exemplary embodiment, a propulsive force occurs due to magnetic fields generated by the electromagnets 88, and thereby the moving unit 550 is moved.

Back to FIG. 7, another configuration example of the printing apparatus 500 will be described.

Figure 7C:
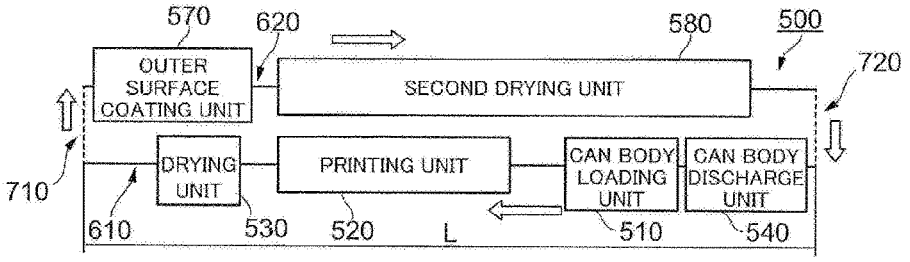

In the configuration example shown in FIG. 7C, the second linear unit 620 is provided with the outer surface coating unit 570 and the second drying unit 580. Further, in this configuration example, the can body discharge unit 540 is installed to the first linear unit 610, the can body discharge unit 540 also being installed on the upstream side of the can body loading unit 510.

In the configuration example shown in FIG. 7B, the first linear unit 610 is provided with the outer surface coating unit 570 and the second drying unit 580; accordingly, the first linear unit 610 is elongated. In contrast thereto, in the configuration example shown in FIG. 7C, the outer surface coating unit 570 and the second drying unit 580 are provided to the second linear unit 620. In this case, the full length L of the printing apparatus 500 can be reduced.

Further, in the configuration example shown in FIG. 7C, the second drying unit 580 is positioned above the printing unit 520, and therefore, it is possible to prevent the heat from the second drying unit 580 from affecting the printing unit 520. To additionally describe, in the configuration example shown in FIG. 7C, the second drying unit 580 is provided to a linear portion at an uppermost stage, and therefore, it becomes possible to suppress occurrence of inconveniences due to the heat of the second drying unit 580, as compared to the case in which the second drying unit 580 is provided at the lower side.

Figure 7D:
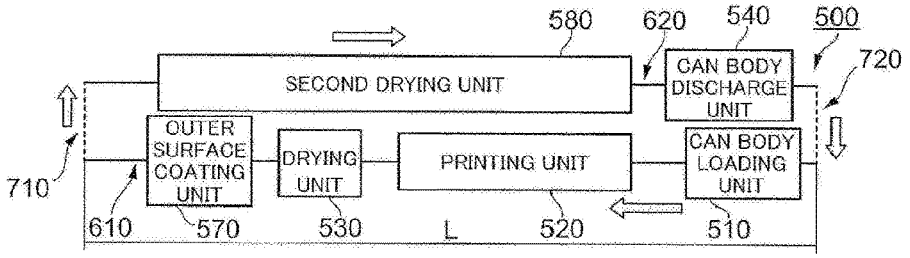

In the configuration example shown in FIG. 7D, the outer surface coating unit 570 is provided to the first linear unit 610, whereas, the second drying unit 580 and the can body discharge unit 540 are provided to the second linear unit 620.

In this case, also, as compared to the configuration example shown in FIG. 7B, the full length L of the printing apparatus 500 can be reduced. Moreover, it is possible to suppress occurrence of inconveniences caused by heat.

Figure 7E:
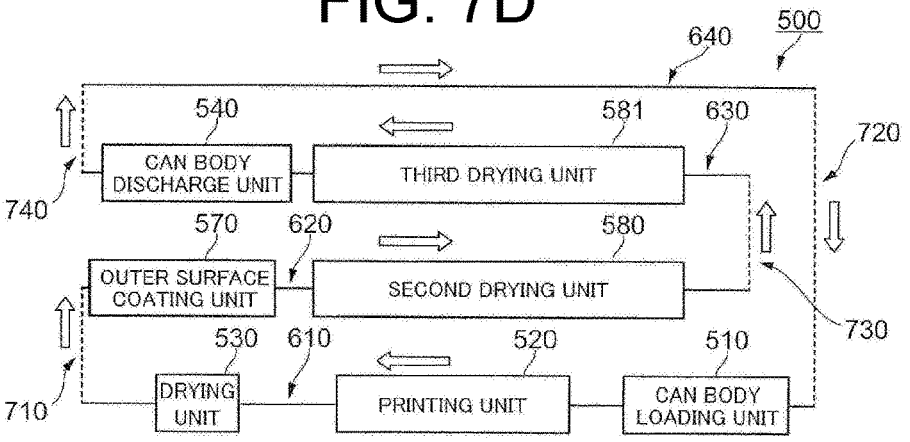

In the configuration example shown in FIG. 7E, above the first linear unit 610 and the second linear unit 620, a third linear unit 630 and a fourth linear unit 640 are further provided.

Further, there is provided a third moving mechanism 730 that moves the moving unit 550 having moved through the second linear unit 620 to the third linear unit 630, and a fourth moving mechanism 740 that moves the moving unit 550 having moved through the third linear unit 630 to the fourth linear unit 640.

Further, in this configuration example, the third linear unit 630 is provided with a third drying unit 581 that further heats the can body 10. Needs to increase the drying time arise in response to the material of the paint, the heating time, and the like; therefore, in this configuration example, the third drying unit 581 is provided in addition to the second drying unit 580.

Further, in this configuration example, the fourth linear unit 640 positioned at the uppermost stage serves as a route for returning the moving unit 550, from which the can body 10 has been discharged, to the can body loading unit 510.

Here, for example, in the configuration example shown in FIG. 7D, if the second drying unit 580 is elongated, similar to the configuration example shown in FIG. 7E, it is possible to increase the heating time of the can body 10. However, in this case, the full length of the printing apparatus 500 is increased, and thereby, the occupation area of the printing apparatus 500 is increased.

In contrast thereto, as shown in FIG. 7E, by providing the second drying unit 580 to the second linear unit 620 and third drying unit 581 to the third linear unit 630, it is possible to reduce the full length of the printing apparatus 500 and to reduce the occupation area of the printing apparatus 500.

Figure 8A:
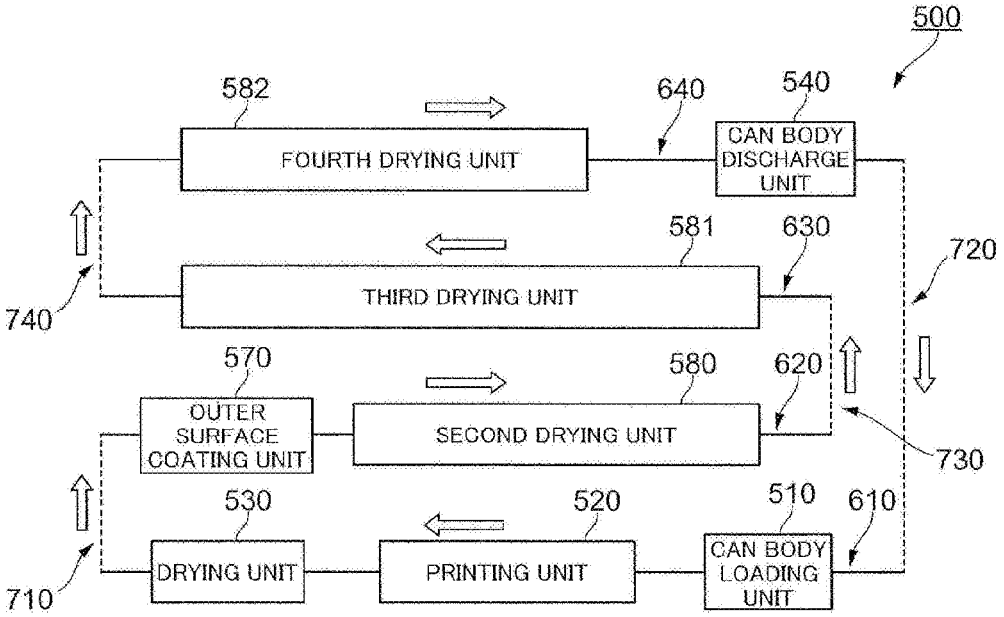
FIGS. 8A and 8B are diagrams showing other configuration examples of the printing device.

In the configuration example shown in FIG. 8A, similar to the above, the third linear unit 630 and the fourth linear unit 640 are provided above the first linear unit 610 and the second linear unit 620.

Further, there is provided the third moving mechanism 730 that moves the moving unit 550 having moved through the second linear unit 620 to the third linear unit 630, and the fourth moving mechanism 740 that moves the moving unit 550 having moved through the third linear unit 630 to the fourth linear unit 640.

Further, in this configuration example, in addition to the second drying unit 580, there are provided the third drying unit 581 and a fourth drying unit 582 that further heat the can body 10.

The third drying unit 581 is provided to the third linear unit 630. The fourth drying unit 582 is provided to the fourth linear unit 640.

In this configuration example, also, while sufficiently securing the drying time of the can body 10, the occupation area of the printing apparatus 500 can be reduced.

Figure 8B:
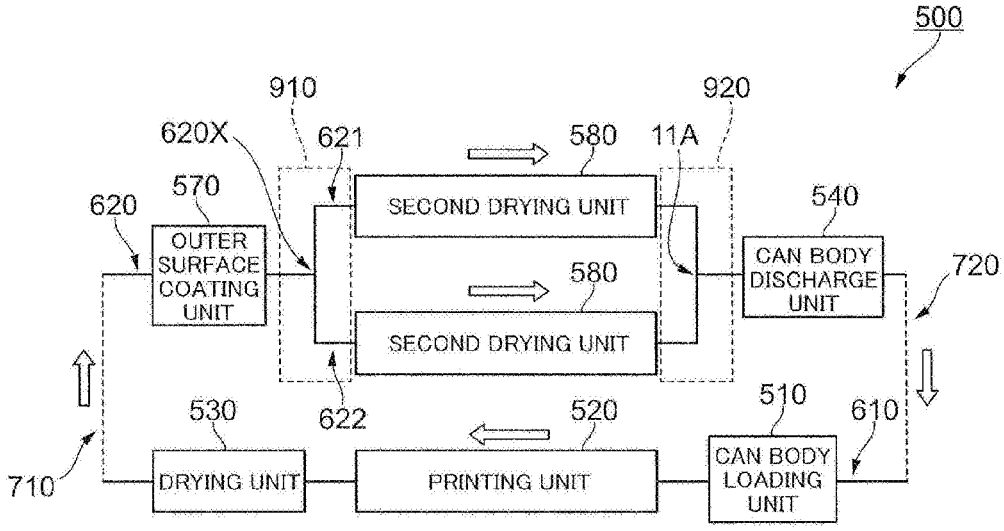

In the configuration example shown in FIG. 8B, two linear units, the first linear unit 610 and the second linear unit 620, are provided. Further, in the second linear unit 620, the moving route of the moving unit 550 is branched in the vertical direction; thereby, the second linear unit 620 is provided with two linear units, an upper linear unit 621 and a lower linear unit 622.

In other words, in the configuration example shown in FIG. 8B, the second linear unit 620 serves as the moving route of the can body 10, and the moving route branches to plural moving routes at a branch part 620X and the moving routes are joined on the downstream side (downstream side in the conveyance direction of the can body 10) of the branch part 620X.

Then, in this configuration example, each of conveyance routes (each of the upper linear unit 621 and the lower linear unit 622) is provided with the second drying unit 580.

Further, the second linear unit 620 is provided with a distribution mechanism 910 that distributes the moving unit 550 having been conveyed from the upstream side to any one of the upper linear unit 621 and the lower linear unit 622. Moreover, there is provided a reclaiming mechanism 920 that reclaims (joins) the moving units 550 having moved through the upper linear unit 621 and the lower linear unit 622.

In this configuration example, also, while securing the drying time of the can body 10, the occupation area of the printing apparatus 500 can be reduced.

The distribution mechanism 910 and the reclaiming mechanism 920 can be configured with, for example, a mechanism similar to the first moving mechanism 710 shown in FIG. 4.

In the first moving mechanism 710 shown in FIG. 4, when the moving unit 550 is placed onto the support base 713A, the moving unit 550 is moved toward the support base 713A from the right side in the figure; however, when a mechanism similar to the first moving mechanism 710 is provided in the configuration example shown in FIG. 8B, the moving unit 550 is moved from the left side, not from the right side, of the support base 713A.

Then, the moving unit 550 is placed onto the support base 713A. Thereafter, the support base 713A moves to any one of the upper side and the lower side, and thereby the moving unit 550 is moved onto the extended line of the upper linear unit 621 or the extended line of the lower linear unit 622. Then, the moving unit 550 is moved to the upper linear unit 621 or the lower linear unit 622.

Moreover, in the configuration example shown in FIG. 8B, when the moving unit 550 is reclaimed (when reclamation is performed in the reclaiming mechanism 920), the moving unit 550 is moved from the left side of the support base 713A. Then, the moving unit 550 is temporarily placed onto the support base 713A, and thereafter, moved to a junction 11A (refer to FIG. 8B) of the upper linear unit 621 and the lower linear unit 622.

Thereafter, the moving unit 550 travels a part of the second linear unit 620 that is positioned at the downstream side of the junction 11A to reach the can body discharge unit 540. Thereafter, the moving unit 550 is moved to the first linear unit 610 via the second moving mechanism 720.

In the configuration example shown in FIG. 8B, as compared to the configuration examples shown in FIG. 7D and the like, it is possible to increase the number of can bodies 10 on which printing can be performed per unit time.

Here, in the drying unit for heating the can body 10, such as the second drying unit 580, the conveyance speed of the can body 10 is often reduced for sufficiently securing the heating time. In this case, the printing efficiency is likely to be deteriorated. Specifically, when the conveyance speed is reduced in the drying unit, in response thereto, needs to reduce the conveyance speed of the can body 10 arise in the printing unit 520, too, and therefore, the printing efficiency is likely to be deteriorated.

In contrast thereto, in the configuration example shown in FIG. 8B, for example, the can bodies 10 are alternately supplied to the upper linear unit 621 and the lower linear unit 622, and the can bodies 10 are dried in both of the upper linear unit 621 and the lower linear unit 622.

In such a case, reduction of the conveyance speed of the can body 10 in the printing unit 520 can be suppressed, and accordingly, deterioration of the printing efficiency can be suppressed.

In FIGS. 7A to 8B, description was given of the case in which the first linear unit 610 to the fourth linear unit 640 were disposed three-dimensionally. In other words, in FIGS. 7A to 8B, the configuration example in which the first linear unit 610 to the fourth linear unit 640 were disposed in multiple stages was described.

By the way, the first linear unit 610 to the fourth linear unit 640 may be disposed flatly, not limited to such multi-stage disposition. In other words, similar to the embodiment shown in FIG. 1, the first linear unit 610 to the fourth linear unit 640 may be disposed to extend in the horizontal direction (lateral direction). To additionally describe, the first linear unit 610 to the fourth linear unit 640 may be disposed so that the first linear unit 610 to the fourth linear unit 640 are placed on a single horizontal surface.

In this case (when the first linear unit 610 to the fourth linear unit 640 are disposed to extend in the horizontal direction (lateral direction)), the configuration example shown in FIG. 7A becomes the one schematically showing the configuration example shown in FIG. 1. Moreover, in this case, the two linear units, the upper linear unit 621 and the lower linear unit 622, shown in FIG. 8B are disposed to be shifted in the horizontal direction, not in the vertical direction. Then, in this case, the conveyance route of the can body 10 is branched horizontally, not vertically.

Note that disposition of the two linear units, the upper linear unit 621 and the lower linear unit 622, may be different from disposition of the first linear unit 610 to the fourth linear unit 640.

For example, while disposing the first linear unit 610 to the fourth linear unit 640 three-dimensionally (in multiple stages), the two linear units, the upper linear unit 621 and the lower linear unit 622, may be disposed to be shifted in the horizontal direction. Moreover, for example, while disposing the first linear unit 610 to the fourth linear unit 640 to be shifted in the horizontal direction (disposing thereof to be placed on a single horizontal surface), the two linear units, the upper linear unit 621 and the lower linear unit 622, may be disposed to be shifted in the vertical direction.

Figure 11:
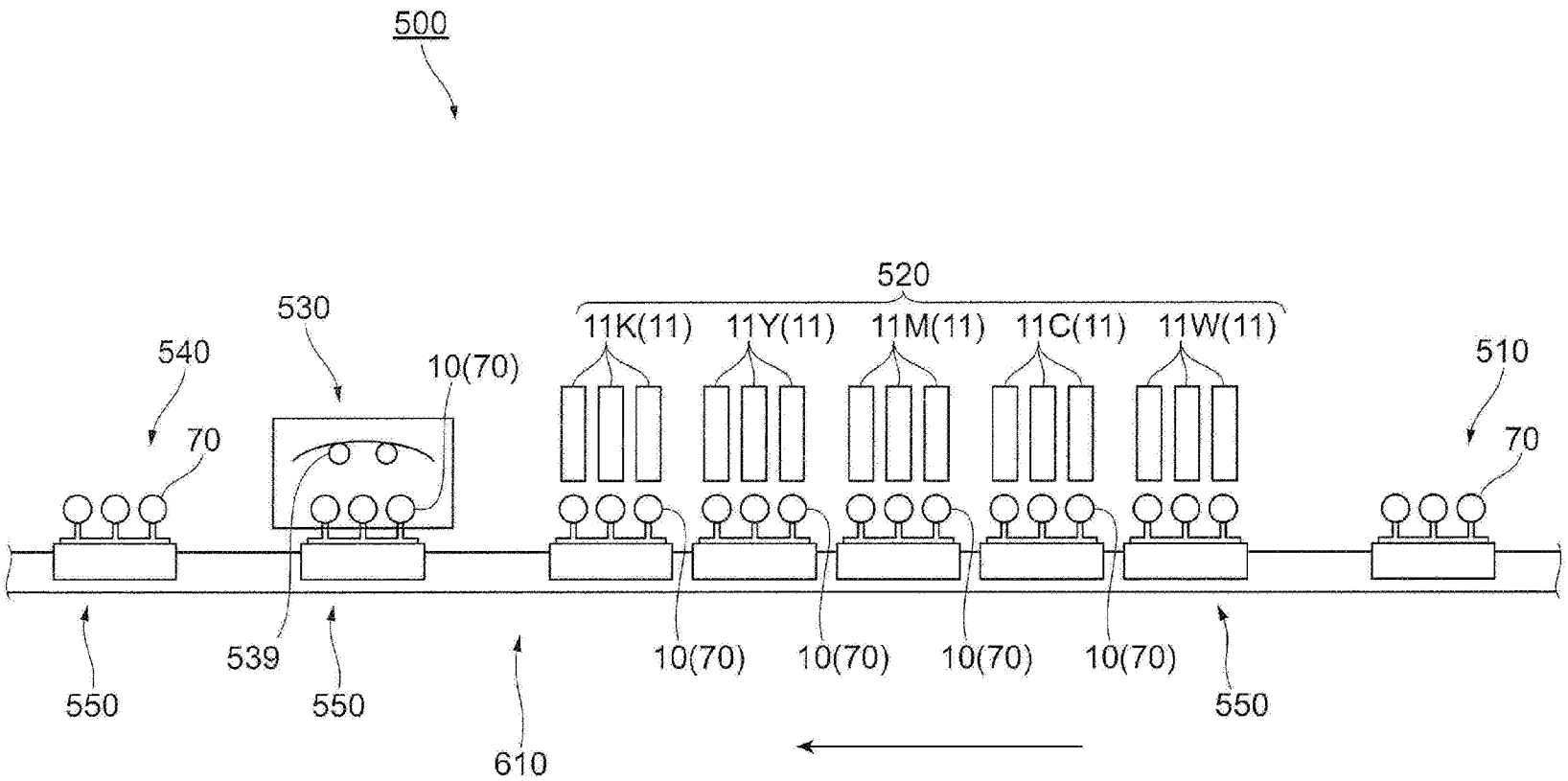
FIG. 11 is a diagram showing another configuration example of a first linear unit of the printing apparatus.

FIG. 11 is a diagram showing another configuration example of the first linear unit 610 of the printing apparatus 500.

In this configuration example, a single moving unit 550 is provided with three (plural) mandrels 70, and therefore, each moving unit 550 moves while holding three can bodies 10.

Further, the printing unit 520 is provided with three inkjet heads 11 of the same color corresponding to the three mandrels 70. Specifically, three inkjet heads 11 are provided for each color.

In this configuration example, ink of the same color is ejected at the same timing. Consequently, as compared to the case in which ink of the same color is ejected at the different timing, control of printing can be easily performed.

In this configuration example shown in FIG. 11, each moving unit 550 stops below the three inkjet heads 11 provided for each color.

Then, in each moving unit 550, the three can bodies 10 are rotated, and further, ink ejection from the three inkjet heads 11 ejecting ink of the same color is performed onto the three can bodies 10. Consequently, an image is formed on the outer circumferential surface of the can body 10. In this configuration example, as compared to the case in which only one inkjet head 11 is provided for each color, the printing efficiency can be increased.

Further, in this configuration example, when the moving unit 550 reaches the drying unit 530, UVLEDs 539 irradiate the three can bodies 10 placed on the moving unit 550 with ultraviolet light. This causes the image formed on each of the three can bodies 10 to be cured.

Thereafter, the moving unit 550 reaches the can body discharge unit 540 and the can body 10 is detached from each of the three provided mandrels 70 at the can body discharge unit 540.

Note that, when the three mandrels 70 are installed to the moving unit 550 and each mandrel 70 is coated with paint (when the protection layer is formed), as shown in FIG. 9B, it is preferable to provide plural (three) contact rolls 571 to correspond to the three can bodies 10, and to apply the paint by use of the plural contact rolls 571.

Here, when the plural mandrels 70 are provided to the moving unit 550, it is preferable to set the number of mandrels 70 to be installed in the range of two to four. If the number exceeds four, the moving unit 550 becomes heavy; accordingly, there is a possibility that it becomes difficult to control the moving unit 550. Specifically, if the moving unit 550 becomes heavy, the inertia force of the moving unit 550 when the moving unit 550 stops is increased, and therefore, the stop position of the moving unit 550 is likely to be deviated from the intended position.

Further, if a large number of mandrels 70 are installed in the moving unit 550, the moving unit 550 is upsized, and, with this, the printing apparatus 500 is also upsized.

Here, in the exemplary embodiment, if the number of mandrels 70 to be installed in the moving unit 550 is increased, the number of contact rolls 571 and supply rolls 572 shown in FIG. 9B to be installed is also increased with this.

Here, the diameters of the contact roll 571 and the supply roll 572 are relatively large; therefore, the separation distance between the contact rolls 571 adjacent to each other and the separation distance between the supply rolls 572 adjacent to each other are large.

Then, in this case, in response to the separation distances, there arises the need to increase the separation distance between the mandrels 70 installed in each moving unit 550; in such a case, the moving unit 550 is upsized and the printing apparatus 500 is also upsized with this.

In response thereto, in the case where the number of mandrels 70 to be installed is set to two to four, that is, the number of mandrels 70 to be installed is small, the number of contact rolls 571 and the supply rolls 572 to be installed is reduced, and, with this, it is possible to suppress upsizing of the moving unit 550. Then, in this case, it is also possible to suppress upsizing of the printing apparatus 500.

Figure 12:
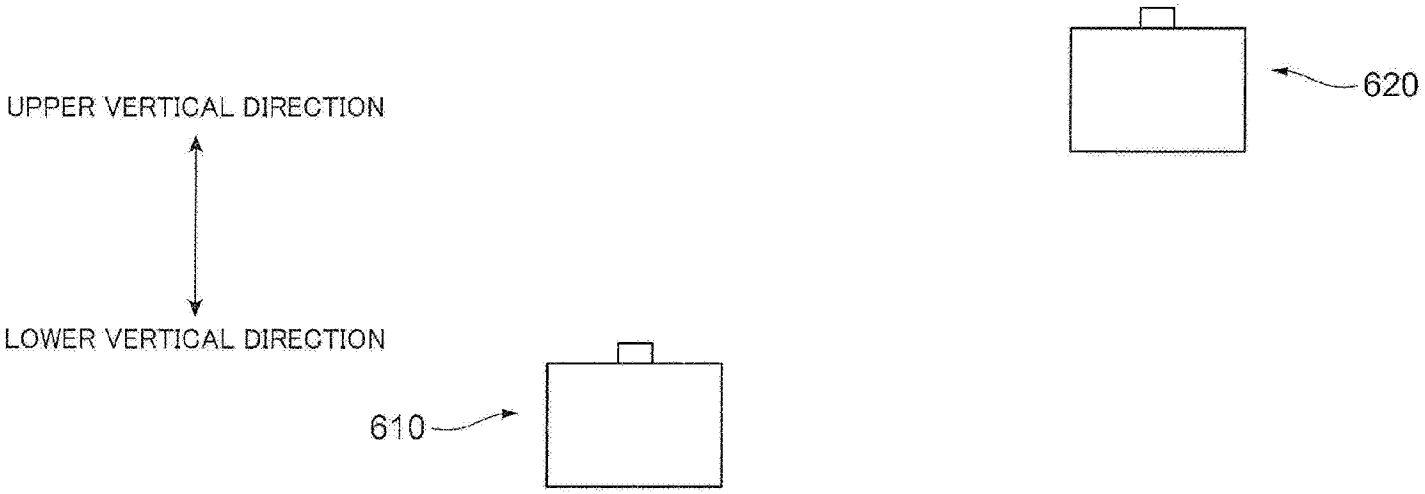

Moreover, in the configuration examples shown in FIGS. 4, 7A to 8B, description was given of the case in which, directly above the first linear unit 610 (above the first linear unit 610 in the vertical direction), other linear units, such as the second linear unit 620, are installed; however, not limited to the location directly above the first linear unit 610, these other linear units may be disposed at locations deviated from the directly above location as shown in FIG. 12 (the diagram in which the printing apparatus 500 is viewed from one end side in the axial direction of the first linear unit 610 or the like).

In this case, as compared to the case in which the second linear unit 620 and the like are positioned directly above the first linear unit 610, maintenance or the like of the first linear unit 610 or various kinds of functional units provided to the first linear unit 610 (not shown in FIG. 12) becomes easy to be performed.

Figure 13:
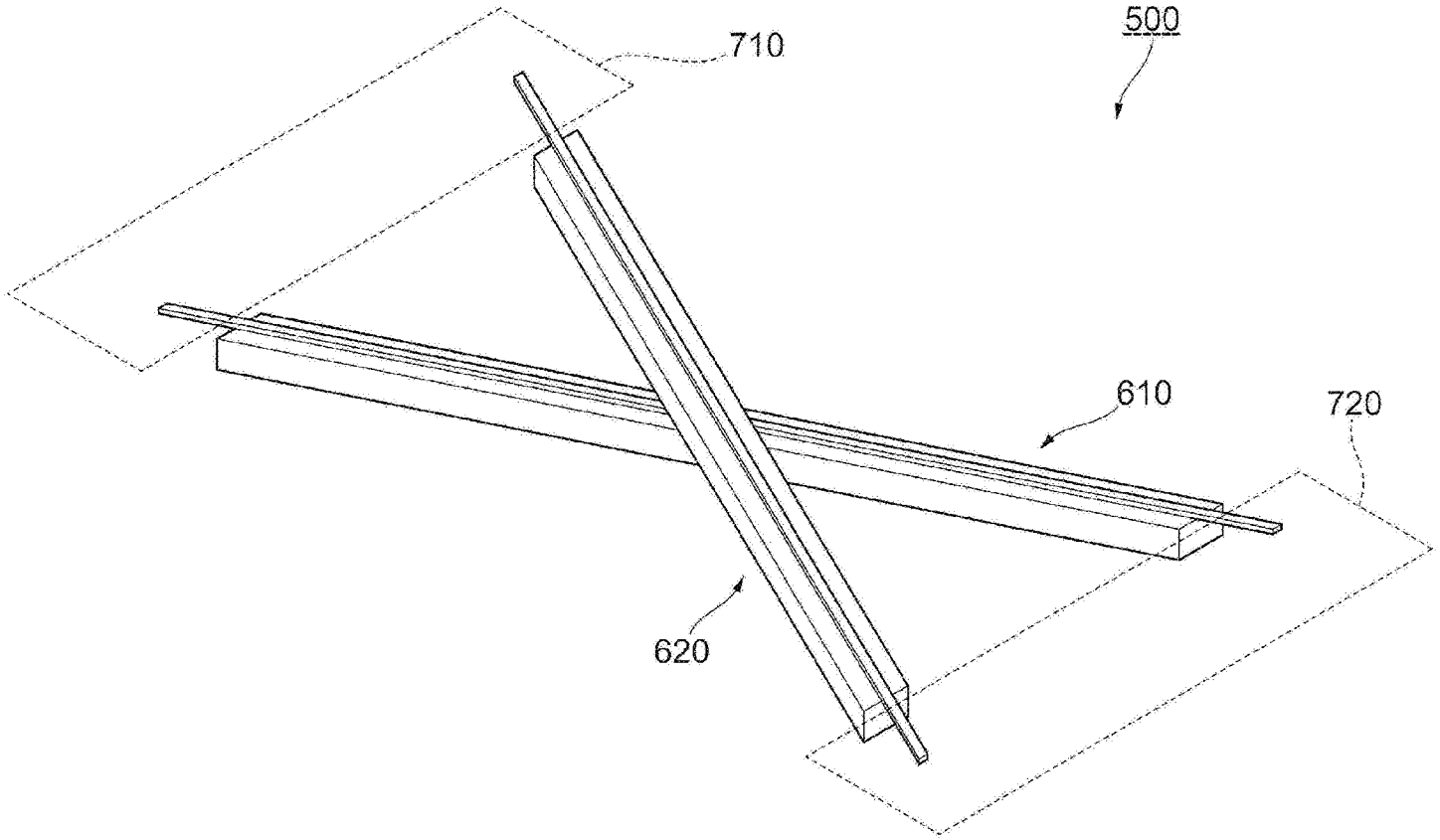
FIG. 13 is a diagram showing another configuration example of the printing apparatus.

Further, when the linear units are disposed to be shifted in the vertical direction, other than the mode in which the linear units are disposed in parallel to one another, as shown in FIG. 13 (the diagram showing another configuration example of the printing apparatus 500), the linear units may be disposed in non-parallel relationship. However, by disposing the linear units in parallel with one another, it is possible to downsize the printing apparatus 500.

Moreover, in the configuration example shown in FIG. 2, description was given of the case in which the moving unit 550 is moved in the lateral direction by use of the rotation disk 711. In other words, in FIG. 2, for moving the moving unit 550 between the two linear units 610 and 620 disposed on the same horizontal surface, the rotation disk 711 is used. By the way, when the rotation disk 711 is used, not limited to the movement of the moving unit 550 in the lateral direction, it is possible to move the moving unit 550 in the vertical direction.

Specifically, for example, by disposing the second linear unit 620 at a position facing the position indicated by the reference sign 2E in FIG. 2, it is possible to move the moving unit 550 that has been moved from the first linear unit 610 to the second linear unit 620 positioned obliquely upward of the first linear unit 610.

Further, it is possible to move the moving unit 550 that has been moved from the second linear unit 620 to the first linear unit 610 positioned obliquely downward of the second linear unit 620.

Moreover, for example, by disposing the first linear unit 610 at a position facing the position indicated by the reference sign 2F in FIG. 2 and the second linear unit 620 at a position facing the position indicated by the reference sign 2E, it is possible to move the moving unit 550 that has been moved from the first linear unit 610 to the second linear unit 620 positioned directly above the first linear unit 610.

Moreover, in this case, it is possible to move the moving unit 550 that has been moved from the second linear unit 620 to the first linear unit 610 positioned directly below the second linear unit 620.

Figure 14:
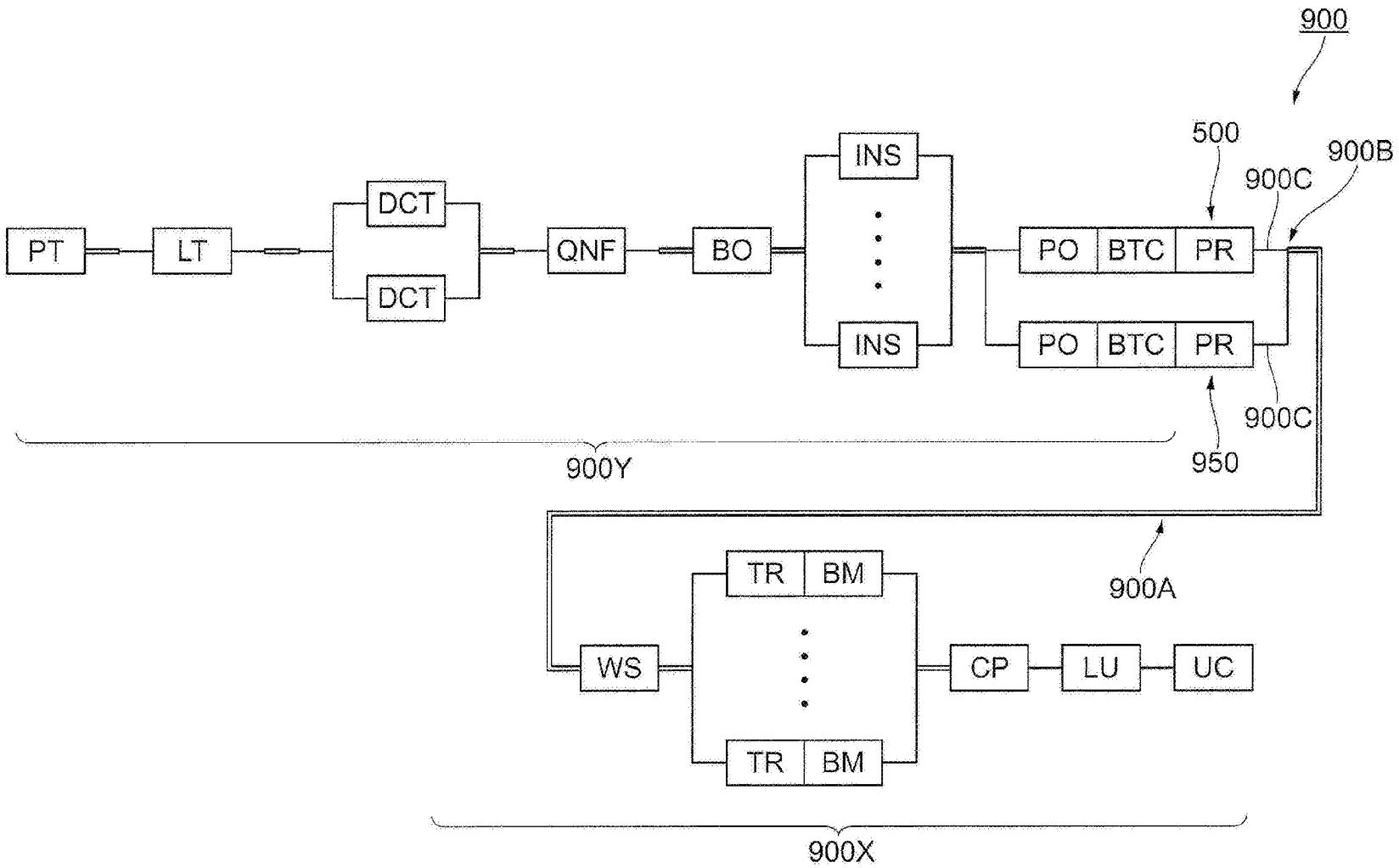
FIG. 14 is a diagram showing entirety of manufacturing processes of the can body.

FIG. 14 is a diagram showing entirety of manufacturing processes of the can body 10. In other words, FIG. 14 is a diagram showing entirety of a can body manufacturing system 900 including the printing apparatus 500.

In the can body manufacturing system 900 shown in FIG. 14, the above-described printing apparatus 500 is provided in the middle of the manufacturing processes. In other words, there is provided the printing apparatus 500 that performs printing on the can body 10 by the ink jet method.

Further, the can body manufacturing system 900 is provided with a plate printing apparatus 950 that performs printing on the can body 10 by the so-called plate printing. In the plate printing apparatus 950, ink adhered to a plate is transferred onto the can body 10, to thereby perform printing on the can body 10.

In the can body manufacturing system 900, a moving route 900A of the can body is provided. Here, the moving route 900A is branched to plural branch routes 900C at a branch part 900B, and the branch routes 900C join at the downstream side of the branch part 900B.

Further, in the can body manufacturing system 900, the printing apparatus 500 is provided to one branch route 900C of the plurally provided branch routes 900C, and the plate printing apparatus 950 is provided to the other branch route 900C.

Further, the branch part 900B is provided with a distribution mechanism (not shown in the figure) that can distribute the can body 10 that has been conveyed from the upstream side to the one branch route 900C or the other branch route 900C; therefore, the can body 10 having been conveyed from the upstream side is distributed to any one of the printing apparatus 500 and the plate printing apparatus 950. When printing on the can body 10 by the printing apparatus 500 or the plate printing apparatus 950 is finished, the can body 10 is further conveyed to the downstream side.

On the upstream side of the printing apparatus 500 and the plate printing apparatus 950, there is provided an upstream side process 900X, and, on the downstream side of the printing apparatus 500 and the plate printing apparatus 950, there is provided a downstream side process 900Y.

Here, in the exemplary embodiment, the upstream side process 900X and the downstream side process 900Y can be commoditized. In other words, in the exemplary embodiment, there is no need to provide the upstream side process 900X and the downstream side process 900Y to correspond to each of the printing apparatus 500 and the plate printing apparatus 950, and thereby, only by a single upstream side process 900X and downstream side process 900Y, the can body 10 on which inkjet printing has been performed and the can body 10 on which plate printing has been performed can be manufactured.

By commoditizing the upstream side process 900X and the downstream side process 900Y, it is possible to reduce costs, and further, it is possible to reduce an occupation area of the can body manufacturing system 900.

Note that the upstream side process 900X is provided with processes of: uncoiler (UC); lubricator (LU); cupping press (CP); body maker (BM); trimmer (TR); and washer (WS).

In the uncoiler (UC), an aluminum thin plate wound around a coil is unwound. In the lubricator (LU), the aluminum thin plate is coated with lubricating oil. In the cupping press (CP), a circular-shaped blank is punched and is further subjected to drawing, to thereby mold a cup-shaped material.

In the body maker (BM), the above-described cup-shaped material is subjected to the drawing and ironing to make a peripheral wall have a predetermined thickness. Further, a bottom portion thereof is molded to have a dome shape. In the trimmer (TR), an edge part at the upper portion of the peripheral wall is trimmed. Consequently, the can body 10 in a cylindrical shape is formed. In the washer (WS), the can body 10 is washed to remove the lubricating oil or other adhered materials.

Moreover, the downstream side process 900Y is provided with processes of: bottom coater (BTC); pin oven (PO); inside spray (INS); bake oven (BO); necker flanger (QNF); defective can tester (DCT); light tester (LT); and palletizer (PT).

In the bottom coater (BTC), coating is performed on a grounding portion in the bottom surface of the can body 10. In the pin oven (PO), the can body 10 is heated to bake the printing on the outer circumferential surface of the can body 10 and the coating on the can bottom. Note that, in the exemplary embodiment, two pairs of the bottom coater (BTC) and the pin oven (PO) are provided to correspond to each of the printing apparatus 500 and the plate printing apparatus 950; however, only one pair of the bottom coater (BTC) and the pin oven (PO) may be provided to commoditize the facilities.

In the inside spray (INS), the inner surface of the can body 10 is coated. In the bake oven (BO), coating on the inner surface of the can body 10 is baked. In the necker flanger (QNF), the opening edge of the can body 10 is narrowed and a flange for attaching the can lid is formed. In the defective can tester (DCT), the outer appearance and the state of printing are inspected, and if there is any defective item, the item is removed. In the light tester (LT), whether or not there is any puncture in the can body 10 is inspected, and if there is any defective item, the item is removed. In the palletizer (PT), the can body 10 having passed the tests is placed on a pallet.

Figure 15:
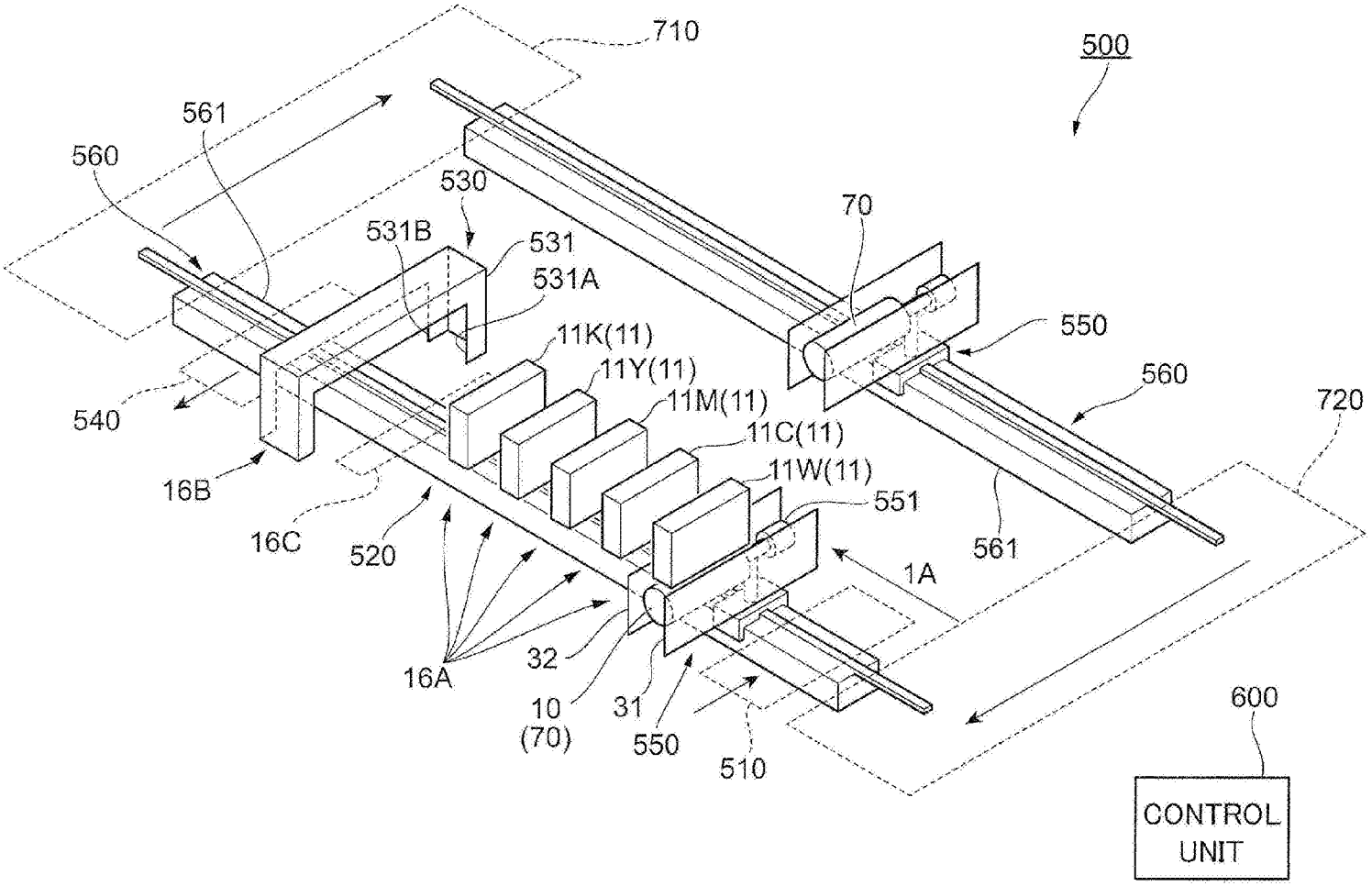
FIG. 15 is a diagram showing another configuration example of the printing apparatus.

FIG. 15 is a diagram showing another configuration example of the printing apparatus 500.

In the configuration example shown in FIG. 15, plural can bodies 10 are sequentially conveyed. More specifically, in the configuration example, the can bodies 10 adjacent to each other are separated for a distance same as the separation distance of the two inkjet heads 11 adjacent to each other, and the can bodies 10 are sequentially conveyed. In other words, in the printing apparatus 500, the can bodies 10 are sequentially conveyed at regular intervals; the interval between the can bodies 10 at this time is the same as the interval between the two inkjet heads 11 adjacent to each other.

Moreover, in the configuration example shown in FIG. 15, the configuration includes one or more other can body stop locations provided between image formation stop locations and a light irradiation stop location.

In the present configuration example, also, every time the can body 10 reaches each of the inkjet heads 11, the can body 10 is stopped. More specifically, every time the can body 10 reaches each of the image formation stop locations indicated by reference signs 16A (hereinafter, referred to as "image formation stop location 16A"), the can body 10 is stopped.

Moreover, when the can body 10 is stopped at the image formation stop location 16A, another can body 10 is stopped at a light irradiation stop location 16B on the downstream side of the image formation stop location 16A. To put it another way, at the drying unit 530 that performs irradiation with ultraviolet light, another can body 10 is stopped.

The drying unit 530 is provided with a light source (not shown in the figure) that emits ultraviolet light and a light source container box 531 that contains the light source.

The light source container box 531 is provided with an inlet portion 531A and an outlet portion 531B, and the can body 10 (the moving unit 550) passes through the inlet portion 531A to enter inside the light source container box 531. Moreover, the can body 10 passes through the outlet portion 531B to go out of the light source container box 531.

Here, in this configuration example, there is provided a can body stop location 16C where neither image formation nor light irradiation is performed between the image formation stop location 16A (the image formation stop location 16A positioned at the most downstream side) and the light irradiation stop location 16B, and thereby ultraviolet light is less likely to reach the inkjet head 11.

In the exemplary embodiment, ultraviolet light is emitted in the drying unit 530, and when the ultraviolet light reaches the inkjet head 11 positioned on the upstream side, there occurs a possibility that the ink is cured to cause ink clogging in the inkjet head 11, and thereby quality of an image to be formed is deteriorated.

Therefore, in the exemplary embodiment, by providing the single can body stop location 16C where one can body 10 is stopped (the can body stop location 16C for stopping one can body 10) between the image formation stop locations 16A and the light irradiation stop location 16B to increase a separation distance between the drying unit 530 and the inkjet head 11, to thereby reduce ultraviolet light that reaches the inkjet head 11.

Note that, in the exemplary embodiment, there is provided the single can body stop location 16C between the image formation stop locations 16A and the light irradiation stop location 16B; however, two or more can body stop locations 16C may be provided.

Moreover, in the configuration example shown in FIG. 15, an upstream-side restricting wall 31 and a downstream-side restricting wall 32 are provided beside each can body 10 (mandrel 70).

The upstream-side restricting wall 31 is positioned on the upstream side of the can body 10 in the moving direction of the moving unit 550, and the downstream-side restricting wall 32 is positioned on the downstream side of the can body 10 in the moving direction of the moving unit 550.

Moreover, the upstream-side restricting wall 31 and the downstream-side restricting wall 32 are disposed along the axial direction of the can body 10 and also along the vertical direction.

Moreover, the plural (plural sets of) upstream-side restricting walls 31 and downstream-side restricting walls 32 are provided to correspond to the respective plural moving units 550 (can bodies 10), and move in association with the respective moving units 550.

The upstream side restricting wall 31 is positioned on the upstream side (the side on which an inkjet head 11 is provided) of a can body 10 when the can body 10 is stopped at the light irradiation stop location 16B (the drying unit 530). The upstream-side restricting wall 31 is thereby positioned between the can body 10 and the inkjet head 11, and ultraviolet light is restricted from heading toward the inkjet head 11.

Moreover, when the can body 10 is stopped at the light irradiation stop location 16B (the drying unit 530), the downstream-side restricting wall 32 is positioned on the downstream side of the can body 10. Consequently, ultraviolet light is restricted from heading toward the downstream side of the can body 10.

Moreover, in this configuration example, when the can body 10 is stopped at the inside of the light source container box 531, the upstream-side restricting wall 31 provided corresponding to the can body 10 closes the inlet portion 531A of the light source container box 531. Consequently, the ultraviolet light is prevented from heading toward the inkjet head 11 through the inlet portion 531A.

Moreover, in this configuration example, when the can body 10 is stopped at the inside of the light source container box 531, the downstream-side restricting wall 32 provided corresponding to the can body 10 closes the outlet portion 531B of the light source container box 531. Consequently, leakage of the ultraviolet light from the outlet portion 531B of the light source container box 531 can be suppressed.

Other than this, in the above, there is no particular description of the number of rotations of the can body 10; however, the number of rotations of the can body 10 may be controlled.

Specifically, for example, it may be possible to control the number of rotations of the can body 10 so that the number of rotations of the can body 10 during a period from starting to move the can body 10 from one of the two inkjet heads 11 adjacent to each other to the other inkjet head 11 in the moving direction of the can body 10 to reaching the other thereof becomes an integer.

Specific description will be given with reference to FIG. 16 (a schematic view in a case where two inkjet heads 11 adjacent to each other are viewed).

Figure 16:
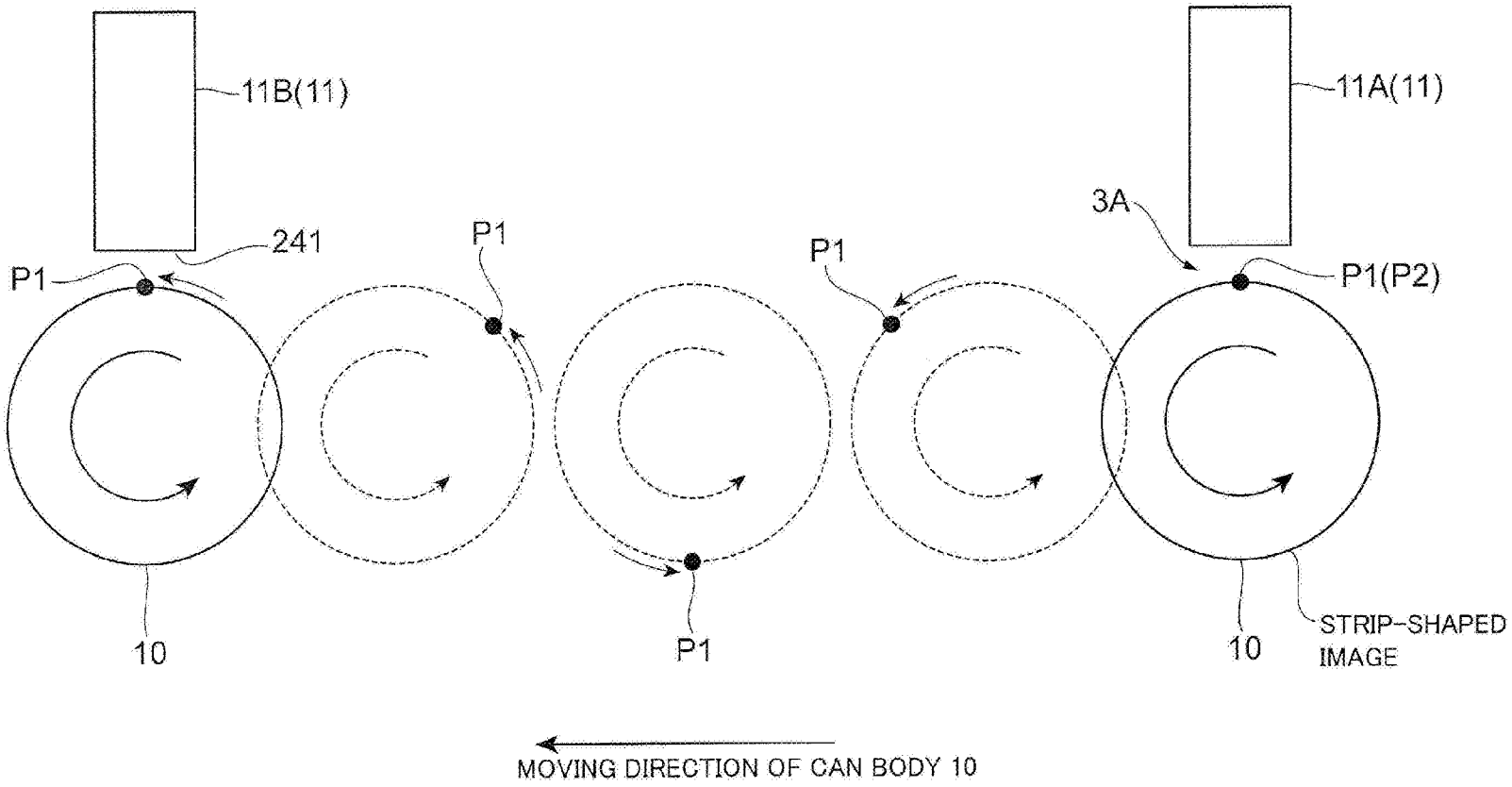
FIG. 16 is a schematic view in a case where two inkjet heads adjacent to each other are viewed.

In the processing shown in FIG. 16, the can body 10 is always rotating, and the can body 10 moves from one of the inkjet heads 11 positioned on the upstream side (the inkjet head on the right side in the figure, which is hereinafter referred to as "upstream-side inkjet head 11A") to the other one of the inkjet heads 11 positioned on the downstream side (the inkjet head 11 on the left side in the figure, which is hereinafter referred to as "downstream-side inkjet head 11B") while rotating.

Then, in the processing, the number of rotations of the can body 10 during the period from starting to move the can body 10 from the upstream-side inkjet head 11A to reaching the downstream-side inkjet head 11B is an integer.

Consequently, in the exemplary embodiment, when the can body 10 reaches the downstream-side inkjet head 11B, an adhesion starting position P1, where the ink ejected from the upstream-side inkjet head 11A is adhered first, is positioned at a position facing the downstream-side inkjet head 11B.

Here, in the upstream-side inkjet head 11A, a strip-shaped image extending from the adhesion starting position P1 (the position indicated by a reference sign 3A) where the ink is first adhered to an adhesion finishing position P2 (the position indicated in the same manner by the reference sign 3A) where the ink is finally adhered is formed on the outer circumferential surface of the can body 10.

Then, in the exemplary embodiment, the can body 10 moves while rotating, and when the can body 10 reaches below the downstream-side inkjet head 11B, the adhesion starting position P1 is located at the position facing a lower surface 241 of the downstream-side inkjet head 11B.

Then, in the exemplary embodiment, ink is ejected at the same time when the can body 10 reaches below the downstream-side inkjet head 11B, to thereby perform image formation.

More specifically, in the exemplary embodiment, movement of the can body 10 is started at the same time when image formation is finished at the upstream-side inkjet head 11A (at the same time when the adhesion starting position P1 faces the upstream-side inkjet head 11A again after the single rotation of the can body 10).

Then, at the same time when the can body 10 reaches below the downstream-side inkjet head 11B (at the same time when the adhesion starting position P1 faces the downstream-side inkjet head 11B), ejection of ink from the downstream-side inkjet head 11B is started, to thereby start image formation.

Here, in this processing, when image formation at the downstream-side inkjet head 11B is started, the adhesion starting position P1 is positioned directly below the downstream-side inkjet head 11B.

Consequently, in the exemplary embodiment, an image formation starting position when image formation at the upstream-side inkjet head 11A is started and an image formation starting position when image formation at the downstream-side inkjet head 11B is started coincide with each other.

Here, if the adhesion starting position P1 does not face the downstream-side inkjet head 11B when the can body 10 reaches the downstream-side inkjet head 11B, control for causing the adhesion starting position P1 to face the downstream-side inkjet head 11B is required.

Specifically, it becomes necessary to, for example, detect the state of the can body 10 by a rotary encoder or the like, and rotate the can body 10 based on the detection result. In contrast to this, in the exemplary embodiment, such control is unnecessary and the image formation starting positions can be aligned easier.

Note that the number of rotations of the can body 10 during the period from starting to move the can body 10 from the upstream-side inkjet head 11A to reaching the downstream-side inkjet head 11B may be any value as long as being an integer, which may be 1, or may be 2 or more.

Moreover, as another processing, when the can body 10 moves from one inkjet head 11 of the two inkjet heads 11 adjacent each other to the other inkjet head 11, the can body 10 may be rotated at the number of rotations larger than a predetermined number of rotations (the number of rotations in image formation).

More specifically, when an image is formed onto the can body 10 in each inkjet head 11, the can body 10 is rotated at the predetermined number of rotations, whereas, when the can body 10 is moved (in the course of moving the can body 10), the can body 10 may be rotated at the number of rotations larger than the predetermined number of rotations.

Here, when the number of rotations is increased like this, the ink on the outer circumferential surface of the can body 10 is more likely to be cured. More specifically, when thermosetting ink, not the ultraviolet cure ink as in the exemplary embodiment, is used for example, the ink is likely to be dried as the number of rotations is increased, and thereby, the ink is cured more quickly as compared to a case in which the number of rotations is not increased.

To additionally describe, in the above, the case in which the ultraviolet cure ink is used is described; however, thermosetting ink can also be used, and in this case, when the number of rotations of the can body 10 is increased, the ink is cured more quickly as compared to a case in which the number of rotations is not increased.

Moreover, as another processing, when the can body 10 moves from one inkjet head 11 of the two inkjet heads 11 adjacent each other to the other inkjet head 11, the can body 10 may be rotated at the number of rotations smaller than the predetermined number of rotations.

More specifically, when an image is formed onto the can body 10 in each inkjet head 11, the can body 10 is rotated at the predetermined number of rotations, whereas, when the can body 10 is moved (in the course of moving the can body 10), the can body 10 may be rotated at the number of rotations smaller than the predetermined number of rotations.

When the number of rotations of the can body 10 is reduced in this manner, the total number of rotations of mechanical sections for rotating the can body 10 is reduced, and thereby wear in the mechanical sections can be suppressed as compared to a case in which the number of rotations of the respective mechanical sections is constant or is increased as described above.

Moreover, in each inkjet head 11, image formation onto the can body 10 may be started after the can body 10 is rotated a predetermined number of times below the inkjet head 11, not to start image formation at the same time when the can body 10 reaches the inkjet head 11.

Immediately after the can body 10 is moved to the location below each inkjet head 11, the can body 10 does not absolutely stop and vibrates in some cases. Particularly, when the moving speed of the can body 10 is high, vibration of the can body 10 is more likely to become large. The vibration of the can body 10 is apt to cause degradation in quality of the image to be formed on the can body 10.

In contrast thereto, by starting the image formation by the inkjet head 11 after rotating the can body 10 below the inkjet head 11 (by starting the image formation by the inkjet head 11 after a certain time has passed), the vibration of the can body 10 is reduced or no vibration occurs, and thereby degradation of the image to be formed on the can body 10 is suppressed.

Other than this, it may be possible to stop the rotation of the can body 10 or reduce the rotation speed of the can body 10 while the can body 10 reaches below the inkjet head 11 and is rotated for a certain period of time. However, in this case, when image formation by the inkjet head 11 is started, it is necessary to accelerate the can body 10, which has been stopped or decelerated, to the rotation speed required to perform image formation, and vibration sometimes occurs in the can body 10 on this occasion.

Moreover, as another control, it may be possible that the image formation starting position when the inkjet head 11 starts image formation (the position of the can body 10 in the circumferential direction) is made to differ in each inkjet head 11, and thereby the image formation starting positions of respective colors are shifted in the circumferential direction of the can body 10.

When the image formation starting positions are aligned, there is a possibility that the portions where the image quality is likely to be deteriorated are concentrated to one location, to result in degradation in image quality. More specifically, at the image formation starting positions, a starting point and an end of the image to be formed overlap or a gap is formed between the starting point and the end, and accordingly, the image quality is likely to be deteriorated. In such a case, if the image formation starting positions are aligned, the image quality is more likely to be deteriorated as compared to the case in which the image formation starting positions are not aligned.

By differentiating the image formation starting position by each inkjet head 11 and shifting the image formation starting positions of the respective colors in the circumferential direction of the can body 10, degradation in image quality can be suppressed.

Note that, as a method of shifting the image formation starting positions by the respective inkjet heads 11, though not particularly limited, for example, by differentiating the ink ejection timing by the respective inkjet heads 11, the image formation starting positions can be shifted.

The invention claimed is:

1. A printing apparatus comprising:

a moving body used for conveying a can body;

a first moving route in a linear shape which the moving body travels when the moving body moves in one direction;

a second moving route disposed in parallel with the first moving route and formed in a linear shape, which the moving body travels when the moving body moves in a direction opposite to the one direction;

a third moving route that moves the moving body from one moving route of the first moving route and the second moving route to an other moving route; and a printing unit that performs printing on a can body held by the moving body, wherein a moving mechanism for moving the moving body in the third moving route is provided apart from a moving mechanism for moving the moving body in the first moving route and a moving mechanism for moving the moving body in the second moving route.

2. The printing apparatus according to claim 1, wherein the printing unit is provided to the first moving route or the second moving route, and, in a moving route of the first moving route and the second moving route, which is provided with the printing unit, a linear mechanism is used to move the moving body.

3. The printing apparatus according to claim 1, wherein one moving route of the first moving route and the second moving route is disposed above an other moving route.

4. The printing apparatus according to claim 1, wherein the third moving route is formed into a linear shape and is disposed in a relationship substantially orthogonal to the first moving route and the second moving route.

5. The printing apparatus according to claim 1, wherein the moving mechanism for moving the moving body in the third moving route includes a rotation body that holds the moving body, the moving mechanism rotating the rotation body around a rotation axis extending along a direction in which the first moving route and the second moving route extend to move the moving body.

6. A can body manufacturing system comprising a moving route on which a can body moves, which is branched to a plurality of branch routes at a branch part, the plurality of branch routes joining at a joining part on a downstream side of the branch part, the moving route including a joining route that is provided on a downstream side in the joining part, an inkjet printing apparatus provided to one branch route included in the plurality of branch routes, the inkjet printing apparatus performing printing onto a can body by an inkjet method; a plate printing apparatus provided to an other branch route included in the plurality of branch routes, the plate printing apparatus performing printing onto a can body by a plate printing method, and a controller adapted to cause the system to perform a common processing to the can body onto which printing has been performed by the inkjet printing apparatus and the can body onto which printing has been performed by the plate printing apparatus along the joining route.

* * * * *